US006334044B1

(12) United States Patent
Wasai et al.

(10) Patent No.: US 6,334,044 B1
(45) Date of Patent: Dec. 25, 2001

(54) IMAGE FORMING APPARATUS

(75) Inventors: Akihiro Wasai, Hachioji; Toshiaki Tanaka, Fukaya, both of (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/692,466

(22) Filed: Oct. 20, 2000

(51) Int. Cl.[7] ..... G03G 15/00

(52) U.S. Cl. ..... 399/388; 399/389; 399/394; 399/396

(58) Field of Search ..... 399/45, 46, 301, 399/388, 389, 394, 396

(56) References Cited

U.S. PATENT DOCUMENTS 6,112,037 * 8/2000 Nagata et al. ..... 399/45

6,118,463 * 9/2000 Houki et al. ..... 399/301 X

* cited by examiner

*Primary Examiner*—Arthur T. Grimley
*Assistant Examiner*—Hoan Tran
(74) *Attorney, Agent, or Firm*—Foley & Lardner

(57) ABSTRACT

Referring to the table of the count values corresponding to the aligning speeds stored in a ROM, the main control unit sets an aligning speed value (Kd: default value) in the aligning motor speed control circuit 193 and calculates the equation $K1=Kd/(-Ta/Tb+(2+\alpha))-1$ measured by the aligning speed adjustment sequence and a new target value $Ka=(Kd+K1)/2+C$. At this time, if $|Kd-K1|\leqq 10$, the main control unit substitutes C=0; if $20\geqq|Kd-K1|>10$, it substitutes C=2 when Kd<K1 and C=−2 when Kd>K1; and if $|Kd-K1|>20$, it substitutes C=4 when Kd<K1 and C=−8 when Kd>K1.

11 Claims, 12 Drawing Sheets

IMAGE FORMING APPARATUS

BACKGROUND OF THE INVENTION

The present invention relates to a image forming apparatus that is represented by apparatuses, such as an electrophotographic-type color electrophotocopying apparatus and a color printer that form color images by superimposing monochromatic images.

Many color image forming apparatuses have employed the following method: four monochromatic-image forming units, each composed of a photosensitive unit and a developing unit, are arranged in series, and a yellow (Y) image, a magenta (M) image, a cyan (C) image, and a black (B) image for reinforcing light and darkness formed by the respective image forming units are laid one on top of another in sequence on a sheet material transported by a transfer belt provided along the image forming units.

Four monochromatic-image forming units, each composed of a photosensitive unit and a developing unit, are arranged in series so as to correspond to a yellow image, a magenta image, a cyan image, and a black image, or a specific number of images defined by subtractive primaries. The transfer belt transports a sheet material made of a transparent resin sheet for sheet paper or an overhead projector. One known method of laying four images one on top of another is such that four images are transferred to an intermediate transferring unit and superimposed one on top of another on the intermediate transfer unit and the superimposed images are transferred to a sheet material at a time.

In these color image forming apparatuses, four color images (four images) are required to be accurately superimposed. Therefore, various types of control are employed to obtain accurately superimposed images.

For example, the control includes the photosensitive unit peripheral speed control and belt peripheral speed control. The photosensitive unit peripheral speed control controls a drum-driving motor to rotate at a constant speed so that a photosensitive-unit peripheral speed, by which an arbitrary point on a peripheral surface of the photosensitive unit provided in each of four photosensitive units is moved, is the same as the belt peripheral speed, by which an arbitrary point on a sheet material transfer belt rotated by a belt driving motor is moved. The belt peripheral speed control detects the rotation speed of a transferring-belt driving motor and thereby controls it to be constant so that the photosensitive-unit peripheral speed is the same as that of the belt. Also, correction is included in the control to be performed for spacings at which portions where the individual photosensitive units of the four image forming units in contact with the sheet material transfer belt. The correction is performed by changing image forming timing for portions where the images are superimposed.

However, in actual operation, it is difficult to obtain a superimposed image that is completely free of deviation for various reasons. The reasons include positional deviations occurring when exposure light is incident on the individual photosensitive units, deviations in pitch of the photosensitive units (image forming units), slippage occurring between a driving roller for driving the sheet material transfer belt and the sheet material transfer belt, the variation in the peripheral speed of the sheet material transfer belt because of changes in the diameter of the driving roller due to thermal expansion.

For these reasons, a run-in control sequence for converging color deviations and an image-density control sequence are also included in the control. The run-in control sequence converges color deviations occurring when images are superimposed. This control is carried out at power-on time and using warm-up time after a cover or the like is opened or shut after sheet materials are jammed or stacked in the apparatus. The image-density control sequence serves to maintain the image density (toner adhesion amount) even when characteristics vary according to the variation in temperature and aged deteriorations.

With the described various corrective control operations being provided, however, color deviation (positional deviation in the superimposed image) occurs. This color deviation occurs when the difference occurs between the peripheral speed of the sheet material transfer belt and the speed of transportation of sheet materials that are transported by an aligning roller toward the sheet material transfer belt.

For example, when the transportation speed of the aligning roller is lower than the peripheral speed of the sheet material transfer belt, the aligning roller causes a load to exert on the sheet material transported by the sheet material transfer belt. The load is exerted in the direction opposing the direction in which the sheet material is transported; therefore, the sheet material is pulled in the aforementioned direction, color deviation occurs on the whole of the sheet material. Also, jitter is caused because of influence of oscillation in paper-feed driving system, which is transferred from the aligning roller.

In contrast, when the transportation speed of the aligning roller is higher than the peripheral speed of the sheet material transfer belt, great deflection occurs on the sheet material. The deflection occurs in a space defined by upper and lower guides provided so as to sandwich the sheet material from the upper and lower sides. That is, the deflection occurs in front and back portions in the direction in which the sheet material is transported between the aligning roller and a roller provided for electrically charging the sheet material is electrostatically attracted onto the sheet material transfer belt. When the deflection of the sheet material increases to a level that cannot be incorporated in the aforementioned space, the deflection extends and thereby causes the sheet material to shake (or, to wave) in the direction in which the sheet material positioned on the sheet material transfer belt is pushed. This causes the position of the sheet material placed on the sheet material transfer belt to deviate, thereby causing color deviation as in the earlier case.

As described above, since the speed at which the aligning roller is required to transport the sheet material has the narrow proper speed range, it is undesirable that the transportation speed of the aligning rollers be faster or slower than the proper speed. Moreover, in adjusting the transportation speed of the sheet material, it is undesirable that the speed be adjusted many times until it has converged at a specific value.

In a monochromatic (e.g., black-only) image forming apparatus, colors need not be superimposed. Moreover, a monochromatic image forming apparatus involving a digital process subjects gradation to a binarization process to express gradation in the density of pixels, which makes jitters less liable to appear. In a color image forming apparatus, however, colors have to be superimposed and the gradation is subjected to a multivalued process, thus forming pixels of different sizes with an equal pitch, which makes jitters conspicuous.

Furthermore, in a small-sized color printer or copying machine, its size is restricted and the distance between the aligning rollers and the image forming section cannot be made longer. The adsorption roller that causes a sheet material to adhere to the transfer belt by suction in the monochromatic mode still remains in the same position even in the color mode, which decreases the slack (or deflection) space.

As a result, a sufficient deflection space for the sheet material cannot be secured between the aligning rollers and the transport rollers for putting the sheet material between them and transporting it and in the sheet material deflection space formed by the top and bottom guide plates located there. In a conventional apparatus of this type, the length that the sheet material can be bent is 2 mm or less and the proper speed range for the A3 longitudinal size 420 mm is as narrow as 0 to 0.48% or less.

BRIEF SUMMARY OF THE INVENTION

The object of the present invention is to provide an image forming apparatus capable of adjusting the relative difference between the sheet material transportation speed of the sheet material feeding unit and that of the image forming unit accurately at its first attempt in such a manner that the relative difference goes in the proper relative speed range and of preventing color shift particularly in the color mode.

According to the present invention, to accomplish the foregoing object, there is provided an image forming apparatus including image forming means for forming an image using developer, feeding means for feeding an image forming medium toward the image forming means, transport means for transporting the fed image forming medium, transfer means for transferring the developer image formed by the image forming means onto the image forming medium, and fixing means for fixing the transferred developer image, the image forming apparatus characterized by comprising: first control means for controlling the feeding speed at which the feeding means feeds the image forming medium, on the basis of an initial set value previously set; first sensing means for, when a specific medium is fed toward the image forming means from the feeding means whose feeding speed is controlled by the first control means, sensing the transportation speed of the specific medium; second sensing means for sensing the transportation speed of the specific medium fed from the feeding means at which the specific medium is transported by the transport means; first computing means for calculating a new set value of the feeding speed at the feeding means controlled by the first control means, from the transportation speed sensed by the first sensing means and the transportation speed sensed by the second sensing means; second computing means for computing a target set value by making a correction according to the difference between the new set value calculated by the first computing means and the initial set value; and second control means for setting the target set value calculated by the second computing means in the first control means and then controlling the feeding speed of the feeding means.

According to the present invention, there is provided an image forming apparatus including image forming means for forming an image using developer, feeding means for feeding an image forming medium toward the image forming means, transport means for transporting the fed image forming medium, transfer means for transferring the developer image formed by the image forming means onto the image forming medium, and fixing means for fixing the transferred developer image, the image forming apparatus characterized by comprising: first control means for controlling the feeding speed at which the feeding means feeds a specific medium, on the basis of an initial set value Kd previously set; first sensing means for sensing the passing time Ta of the specific medium fed toward the image forming means from the feeding means whose feeding speed is controlled by the first control means; second sensing means for, when the specific medium fed from the feeding means is transported by the transport means, sensing the passing time Tb of the specific medium transported over the transport means; first computing means for calculating an expected set value K1 using the equation $K1=Kd/(-Ta/Tb+(2+\alpha))-1$, from the passing time Ta sensed by the first sensing means, the passing time Tb sensed by the second sensing means, a specific allowance ratio $\alpha$ of the feeding speed to the transportation speed of the transport means, and the initial set value Kd; second computing means for determining a correction constant C according to the difference Kd−K1 between the initial set value Kd and the expected set value K1 and calculating a target set value Ka using the equation $Ka=(Kd+K1)/2+C$; and second control means for setting the target set value Ka calculated at the second computing means in the first control means and controlling the feeding speed of the feeding means.

According to the present invention, there is provided an image forming apparatus including image forming means for forming an image using developer, feeding means for feeding an image forming medium toward the image forming means, transport means for transporting the fed image forming medium, transfer means for transferring the developer image formed by the image forming means onto the image forming medium, and fixing means for fixing the transferred developer image, the image forming apparatus characterized by comprising: first control means for controlling the feeding speed at which the feeding means feeds a specific medium, on the basis of an initial count value Kd previously set; first sensing means for sensing the passing time Ta of the specific medium fed toward the image forming means from the feeding means whose feeding speed is controlled by the first control means; second sensing means for, when the specific medium fed from the feeding means is transported by the transport means, sensing the passing time Tb of the specific medium transported over the transport means; first computing means for calculating an expected count value K1 using the equation $K1=Kd+((Tb/Ta-1)\times 100-\alpha)/\tau$, from the passing time Ta sensed by the first sensing means, the passing time Tb sensed by the second sensing means, a specific allowance ratio $\alpha$ of the feeding speed to the transportation speed of the transport means, the change rate $\tau$ of speed for one count in the count value, and the initial count value Kd; second computing means for selecting the equation corresponding to the difference Kd−K1 between the expected count value K1 and initial count value Kd and calculating a target set value Ka; and second control means for setting the target count value Ka calculated at the second computing means in the first control means and controlling the feeding speed of the feeding means.

BRIEF DESCRIPTION OF SEVERAL VIEWS OF THE DRAUING

DETAILED DESCRIPTION OF THE INVENTION

Hereinbelow, referring to the accompanying drawings, a description will be given of a color image forming apparatus according to an embodiment of the present invention.

Figure 1:
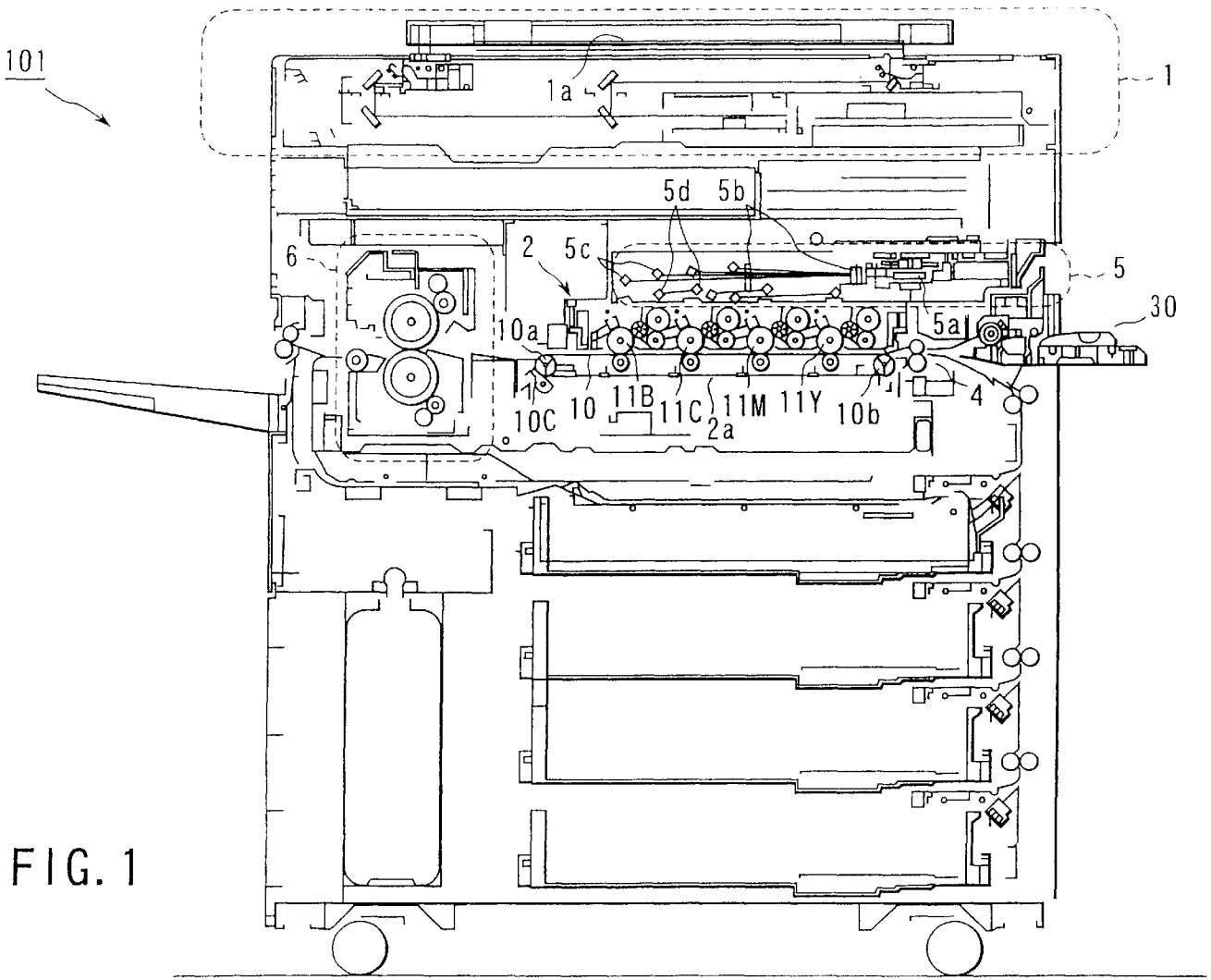
FIG. 1 is a schematic view showing a four-drum color image forming apparatus to which an embodiment of the present invention is applied.

FIG. 1 is a schematic view showing electrophotography-type color image forming apparatus; particularly, the view shows a quadruple-type color photocopying apparatus in which a plurality of electrophotographic image forming sections is provided for the same sheet material transfer belt.

A color photocopying apparatus 101 as shown in FIG. 1 includes an original-material table 1*a* on which a photocopying object, such as an original manuscript or a book, is placed. Image data of an image is read out via a scanner 1 from an original manuscript (not shown) placed on the original-material table 1*a*. Alternatively, image data is received from an external unit represented by a computer or the like (not shown). The image data is then stored in image memory which is described below, and image processing therefor is performed in an image-data processing circuit, which will be described below using FIG. 3, and a color image is formed by an image forming unit 2 described below. As image data, any data pattern that is applicable to each of R, G, and B (additive primaries) or C, M, and Y (subtractive primaries) can be used.

Figure 2:
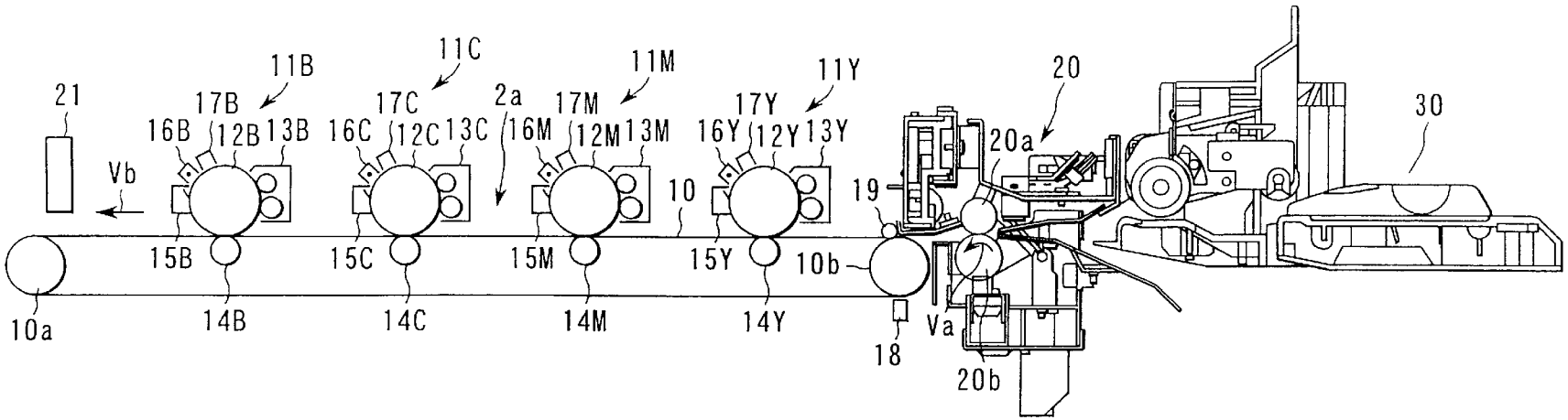
FIG. 2 is a schematic view showing main portions of image forming units in the image forming apparatus shown in FIG. 1.

As shown in an enlarged view in FIG. 2, according to four image forming signals Y (yellow), M (magenta), and C (cyan), which are color-separation elements of the subtractive primaries, and B (semi-black), the image forming unit 2 includes first, second, third, and fourth image forming sections 11. Since many elements constituting the image forming sections 11 are provided for four sets corresponding to the primary colors Y, M, C, and B, the elements are identified by adding the subscripts Y, M, C, and B.

The individual image forming sections 11 are arranged to oppose each other at a predetermined spacing. Also, they are arranged to have a predetermined spacing from an endless belt (sheet material transfer belt) 10 and are arranged along the direction of the face of the sheet material O. The sheet material transfer belt 10 transports transfer materials (image-output mediums), such as sheet papers or sheet materials O made of transparent resin for use with overhead projectors.

In the individual image forming sections 11, photosensitive-unit drums 12 and a developing unit 13 are installed. The photosensitive-unit drum 12 allows forming of latent images corresponding to one of the Y, M, C, and B image forming signals. The developing unit 13 contains toner of the individual primary colors Y, M, C, and B for visualizing the latent images formed on the photosensitive-unit drum 12. The individual image forming sections 11 can be arranged in the sequence optionally defined. In the embodiment of the invention, the individual image forming sections 11 are provided in the sequence of Y, M, C, and B in the direction in which an arbitrary point on the sheet material transfer belt 10 moves, that is, from the upstream side in the direction in which the sheet materials O are transported. The image forming sections 11 are arranged so as to superimpose the four color images in the sequence of Y, M, C, and B.

Around the photosensitive-unit drums 12, transferring units 14 are provided in the positions individually opposing the photosensitive-unit drums 12. The individual transferring units 14 electrostatically adsorb toner images individually formed on the photosensitive-unit drums 12 and transcribe the toner images on the sheet material O that is electrostatically adsorbed on the sheet material transfer belt 10 and is thereby transported.

Also, around the photosensitive-unit drums 12 there are individually provided cleaning units 15, discharging units 16, and charging units 17. The cleaning units 15 remove toner remaining on surfaces of the corresponding photosensitive-unit drums after the individual toner images are transcribed on the sheet material O. The discharging units 16 remove electrical charge remaining in the corresponding photosensitive-unit drums after toner is removed by the corresponding cleaning unit 15. The charging unit 17 gives a predetermined potential to the corresponding the photosensitive-unit drum 12.

The sheet material transfer belt 10 is formed of a conductive urethane rubber material having a thickness of about 0.5 mm, and is wound over a first roller 10*a* (driving roller) and a second roller 10*b* (driven roller). Rotation of the driving roller 10*a* moves an arbitrary point on the sheet material transfer belt 10 in the direction, as a matter of course, in which the sheet materials O are transported. Specifically, in the present embodiment, as viewed from the side where one of the two surface areas closes to the four image forming sections 11,the direction in which the sheet material O is transported is the direction in which the sheet material O moves from the first image forming section 11(Y) to the fourth image forming section 11(B). A peripheral portion of the sheet material transfer belt, which includes a belt motor (described below using FIG. 3B) provided for driving the sheet material transfer belt 10, the driving roller 10*a* and the second roller 10*b*; and the driving roller 10*a* is arranged as a transferring unit 2*a*. The transferring unit 2*a* is arranged so as to be integrally attachable to or detachable from all the photosensitive-unit drums 12 of the image forming sections 11 when a monochromatic image (B image) is formed.

An electrostatically charging unit 18 is provided in a predetermined position close to a transcription-medium supplying section 4, which supplies the sheet materials O onto the sheet material transfer belt 10, over an inner peripheral face of the sheet material transfer belt 10 on the side of the image forming sections 11(Y) with respect to the direction of transportation of the sheet materials O. The electrostatically charging unit 18 allows the sheet material transfer belt 10 to be preliminarily charged with static electricity for adsorbing the sheet materials O. Also, an adsorption roller 19 is provided over an outer peripheral face of the sheet material transfer belt 10. The adsorption roller 19 allows the sheet materials O to be adsorbed onto the sheet material transfer belt 10 preliminarily charged by the electrostatically charging unit 18. Specifically, the adsorption roller 19 is provided in a slightly downstream portion in a direction in which the sheet material O in a position where the sheet material O is controlled to contact the sheet material transfer belt 10 is transported from the transcription-medium supplying section.

An aligning section 20 is provided between the sheet material transfer belt 10 and the transcription-medium supplying section 4; specifically, it is provided in a position spaced apart somewhat farther from the sheet material transfer belt 10 than a position where the sheet materials O are fed by the transcription-medium supplying section 4 onto the peripheral face of the sheet material transfer belt 10 is spaced apart from the sheet material transfer belt 10. The aligning section 20 aligns the sheet materials O so that individual end portions of the sheet materials O that are fed toward the peripheral face of the sheet material transfer belt 10 are positioned perpendicular to the direction in which the sheet materials O are transported. Concurrently, the aligning section 20 allows the sheet materials O to be transported with their end portions being maintained to be perpendicular to the direction in which the sheet materials O are transported. The aligning section 20 includes first and second aligning rollers 20*a* and 20*b* and an aligning motor 20*m* (shown in FIG. 3). The first and second aligning rollers 20*a* and 20*b* sandwich the obverse face and the reverse face of the sheet material O, respectively; and the aligning motor 20*m* drives one of the rollers. In a state where the individual rollers are stopped, the end portion of the sheet material O transported from the transcription-medium supplying section 4 is once stopped, thereby causing its end portion to be deflected. Then, the first and second aligning rollers 20*a* and 20*b* are rotated. When the end portion of the sheet material O returns to the original state, the rotation of the first and second aligning rollers 20*a* and 20*b* keeps the end portion of the sheet material O to be perpendicular to the direction in which the sheet materials are transported, and concurrently, allows to keep the sheet material O to be perpendicular to the transportation direction. In this way, the aligning section 20 aligns the sheet materials O.

Exposing units 5 are provided in predetermined positions over the individual image forming sections 11. The exposing units 5 has laser diodes or the like (not shown). The laser diodes emit exposure light beams (laser beams) with timing set in a timing control section 113 and according to image forming signals for which image-processing is performed by image-data processing sections 115 (described below using FIG. 3) for image data of the individual colors.

Through multiple cylindrical lenses 5*b*, plane mirrors 5*d*, and the like, the exposing units 5 deflect laser beams from the laser diodes, which illuminate according to the image forming signals, the laser beams being changed for their luminous intensities, to the direction of axes of the individual photosensitive-unit drums 12 (direction perpendicular to the direction in which the sheet materials O are transported). Thus, while deflecting the laser beams, the exposing units 5 sequentially emit the laser beams onto the individual photosensitive-unit drums 12. Thereby, electrostatic latent images corresponding to the individual colors are formed on the photosensitive-unit drums 12 of the image forming sections 11.

A fixing unit 6 is provided in a position spaced farther than the first driving roller 10*a* is spaced in the direction in which the sheet materials O are transported. The fixing unit 6 is thus provided to fix four-color toner images formed on the sheet material O. Specifically, the fixing unit 6 includes a first roller (heating roller), a second roller (pressing roller), and a heater (not shown). The heater is provided for heating at least one of the aforementioned rollers. The first roller is cylindrically formed to have a predetermined thickness. The second roller is arranged parallel to the first roller and along the longitudinal direction of the first roller so as to be in contact with a peripheral point of the first roller. The sheet material O is pressed between the two rollers and is fed to pass therethrough. Thus, toner adhered on the sheet material O is heated, and the toner is thereby fixed onto the sheet material O.

FIG. 3 is a schematic block diagram that will be used to explain a control circuit for controlling each of four image forming sections 11 (Y, M, C, and B) of the color photocopying apparatus 101.

According to an image forming start signal issued from a control panel or a host computer, a main control unit 111 starts control, warms up the image forming sections 11 (Y, M, C, and B), and rotates a polygonal mirror 5*a* at a predetermined revolution speed.

Subsequently, control of the main control unit 111 allows image data, which is due to be printed, to be retrieved from an external unit, such as the scanner 1 or a computer, and to be stored in a RAM 121. Part (or, the whole) of the image data retrieved and stored in the RAM 121 is controlled by an image control CPU 112 so as to be stored in four units of image memory 122 (Y, M, C, and B).

Also, control of the main control unit 111 allows the sheet materials O to be fed toward the transcription-medium supplying section 4 from either a cassette or a bypass feeding section 30 with a predetermined timing with reference to, for example, a vertically-synchronous signal or the like, issued from the timing control section 113. The sheet materials O fed from the transcription-medium supplying section 4 are then fed with timing adjusted by the aligning section 20, with which the first and second aligning rollers 20*a* and 20*b* are in contact so as to meet the timing of the individual Y, M, C, and B toner images provided by image forming operation of the individual image forming sections 11 (Y, M, C, and B). Then, the sheet materials O are adsorbed by the adsorption roller 19 onto the sheet material transfer belt 10 and are thereby guided toward the image forming sections 11.

In synchronization with or at the same time as feeding and transporting operations for the sheet materials O, the laser diodes of the exposing units 5 for the individual colors are urged by corresponding laser driving sections 116 (Y, M, C, and B) according to clock signals CLK outputted by a timing setting unit 118 (clock circuit). Concurrently, the laser diodes are subjected to modulation for their intensities corresponding to image data DAT stored in the RAM 121, and are thereby caused to illuminate. According to the above, a laser beam for one line is emitted sequentially from a predetermined position in an effective print width in a main scanning direction parallel to the axial direction of the photosensitive-unit drums 12 of each of the image forming sections 11. Also, the photosensitive-unit drums 12 of the individual image forming sections 11 are rotated by drum motors 12*m* at a predetermined speed. Thereby, the aforementioned laser beams each for one line sequentially emit in the direction of rotation of the photosensitive-unit drums 12. Thereby, electrostatic latent images of the four colors are formed on the photosensitive-unit drums 12 (Y, M, C, and B), each of which is preliminarily given a predetermined surface potential.

These four electrostatic latent images are developed and converted to toner images by the developing units 13 (Y, M, C, and B) using toners of the corresponding colors.

According to the rotation of the photosensitive-unit drums 12 (Y, M, C, and B), the individual toner images are moved toward the sheet materials O, and are sequentially transcribed by the transferring unit 14 onto the sheet material O placed on the sheet material transfer belt 10 at transcription positions where the photosensitive-unit drums 12 and the sheet material transfer belt 10 are in contact with each other.

According to the above, the four toner images accurately overlapped with each other on the sheet material O are formed on the sheet material O.

The sheet material O electrostatically retaining the four toner images is transported by the sheet material transfer belt 10. Then, the sheet material O is separated from the sheet material transfer belt 10 according to the difference between the curvature of the driving roller 10*a* and the linear-forwarding characteristics of the sheet material O, and is guided to the fixing unit 6.

The individual toner particles retained on the sheet material O are heated by the fixing unit 6 to melt, thereby mixing with each other to provide predetermined colors. Thus, the toner images are fixed as a color image, and the sheet material O is fed out to an output tray (not shown).

Figure 3A:
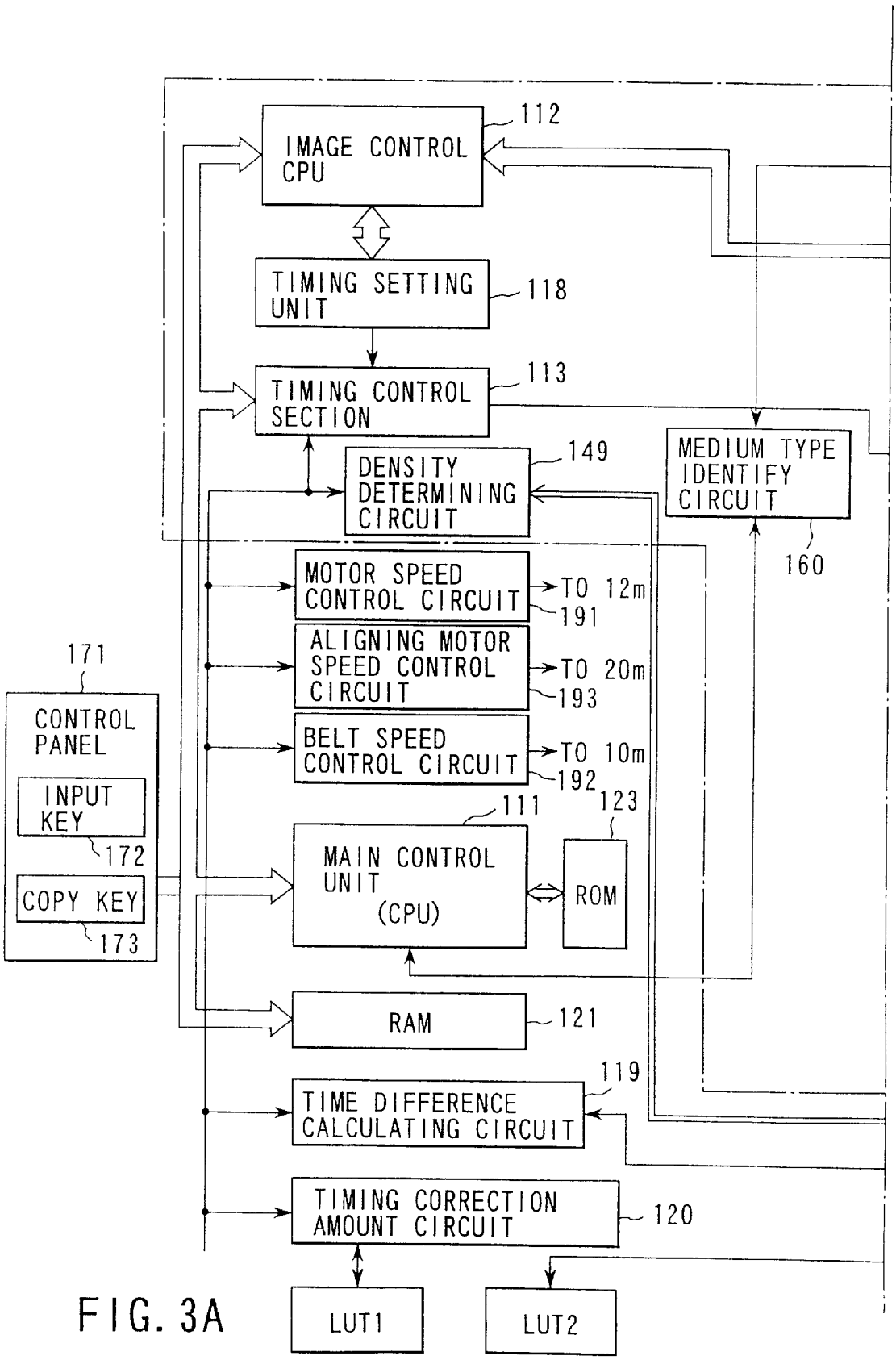
FIGS. 3A and 3B are control block diagrams of the image forming apparatus shown in FIG. 1.
Figure 3B:
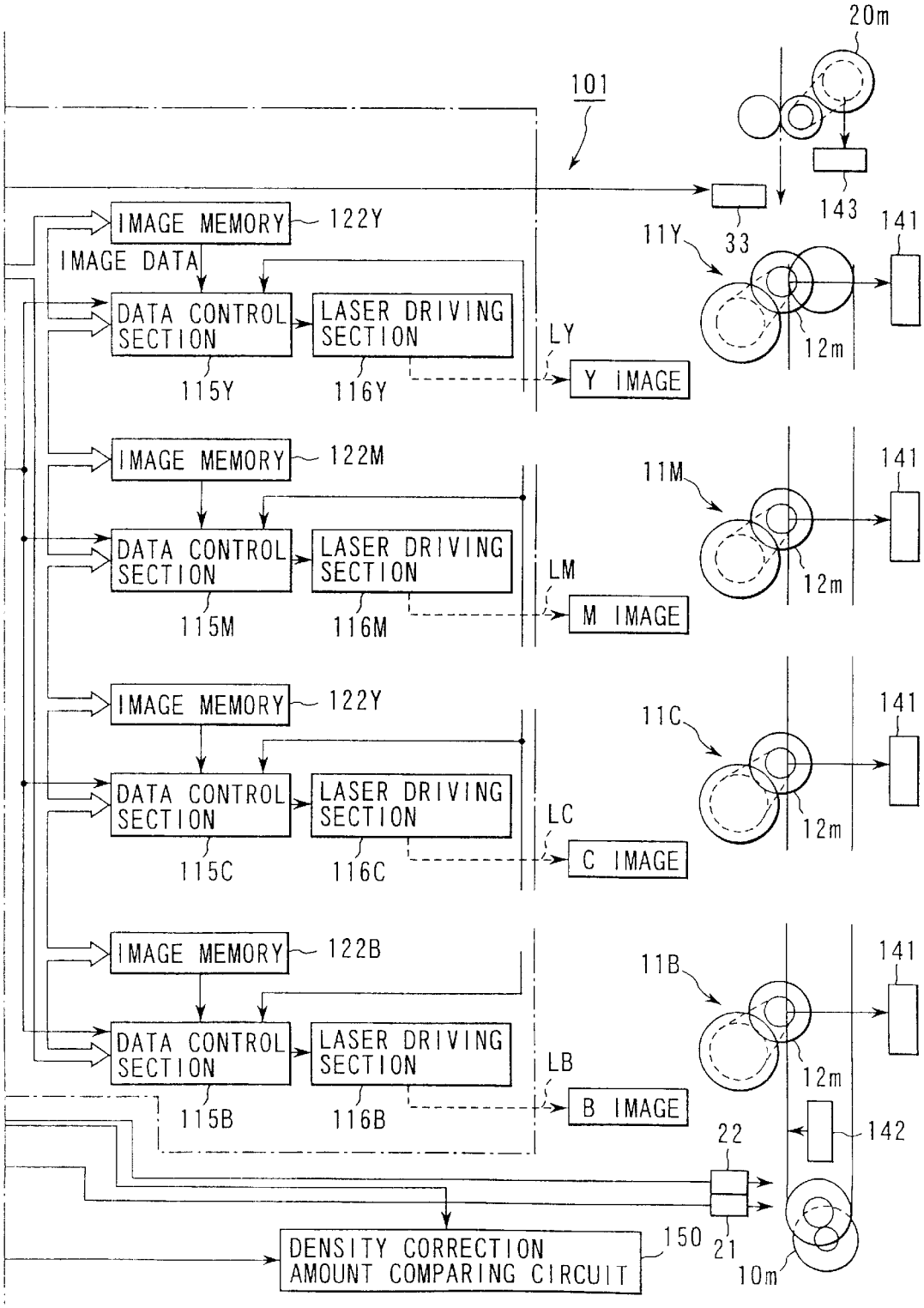

In the described color photocopying apparatus 101, as shown in FIGS. 3A and 3B, the four photosensitive units 12 (Y, M, C, and B) of the image forming sections 11 are driven by the drum motors 12*m* (four motors corresponding to Y, M, C, and B) at an arbitrary number of revolutions. For this reason, compared to the speed at which the sheet materials O are transported, the speeds at which arbitrary points on outer peripheral faces of the drum motors 12*m*,that is, drum peripheral speeds, are not always the same. Therefore, the numbers of revolutions of the individual drum motors 12*m* are detected by motor revolution detecting units 141 and are sent to a motor speed control circuit 191 as speed detecting signals $V_{mdet}$. The number of revolutions of each of the photosensitive-unit drums 12 is amplified by an error difference $V_{merr}$ according to feedback control of the motor speed control circuit 191. The error difference $V_{merr}$ is the difference obtained by comparison between a reference value $V_{mref}$ and the speed detecting signals $V_{mdet}$ detected by the motor revolution detecting units 141. The reference value $V_{mref}$ refers to a reference value of a speed signal that is set so that the moving speeds of peripheral faces of the photosensitive-unit drums 12 can be controlled to be the same as the speed at which an arbitrary point on the sheet material transfer belt 10 is moved (that is, the belt speed). According to the above amplification, the numbers of revolutions of the individual drum motors 12*m* are fed back, and are thereby controlled to be constant. The transportation speed for the sheet materials O, the drum peripheral speeds of the individual photosensitive-unit drums 12, and the speed at which the arbitrary point of the sheet material transfer belt 10 moves are the same. They are called, for example, process speeds.

Similarly, the number of revolutions of a belt motor 10*m* for rotating the driving roller 10*a* for moving the sheet material transfer belt 10 at a predetermined speed in the direction in which the sheet materials O are sent to a belt speed control circuit 192 as a speed detecting signal $V_{bdet}$ generated by a belt speed detecting units 142. The number of revolutions is amplified by an error difference $V_{berr}$ according to feedback control of the belt speed control circuit 192. The error difference $V_{berr}$ is the difference obtained by comparison between a reference value $V_{dref}$ and the speed detecting signals $V_{bdet}$ detected by a belt speed detecting units 142. The reference value $V_{dref}$ refers to a reference value of a speed signal that is set so that the moving speeds of peripheral faces of the photosensitive-unit drums 12 can be controlled to be the same as the belt speed. According to the above amplification, the number of revolutions of the motor 10*m* is fed back, and is thereby controlled to be constant.

The number of revolutions of the aligning motor 20*m* for rotating one of the first and second aligning rollers 20*a* and 20*b* at a predetermined speed is sent to an aligning motor speed control circuit 193 as a speed signal $V_{adet}$ generated by an aligning-motor speed detecting units 143, is compared to a reference value $V_{aref}$, and is thereby controlled to be constant (only during rotation).

In the described color photocopying apparatus 101, the electrostatic latent images are formed by the individual photosensitive-unit drums 12 (Y, M, C, and B) of the four image forming sections 11 (Y, M, C, and B). Then, toner is selectively supplied by the developing units 13 (Y, M, C, and B), which contain toner of corresponding colors, to the electrostatic latent images. Subsequently, the toner images (Y, M, C, and B) are electrostatically adsorbed to the sheet material transfer belt 10, and are transcribed onto the sheet material O transported by movement of the sheet material transfer belt 10. At this time, movement speeds Vm of the peripheral faces of the photosensitive-unit drums 12 and a speed Vb are, as already described, controlled so as to be identical to each other; therefore, theoretically, neither deviation nor blurring should not occur with the toner images.

For equivalence to the spacing between the portions where the four photosensitive-unit drums 12 are in contact with the sheet material transfer belt 10 in the direction in which the sheet material transfer belt 10 moves, timing with which the image is formed in each of the forming sections 11 of the individual colors (Y, M, C, and B) is shifted by: inter-photosensitive-unit spacing for the individual colors/speed of the sheet material transfer belt 10 (process speed).

In this way, the color toner image obtained by superimposing the toner images of the individual colors is fixed by the fixing unit 6 onto the sheet material O.

Figure 4:
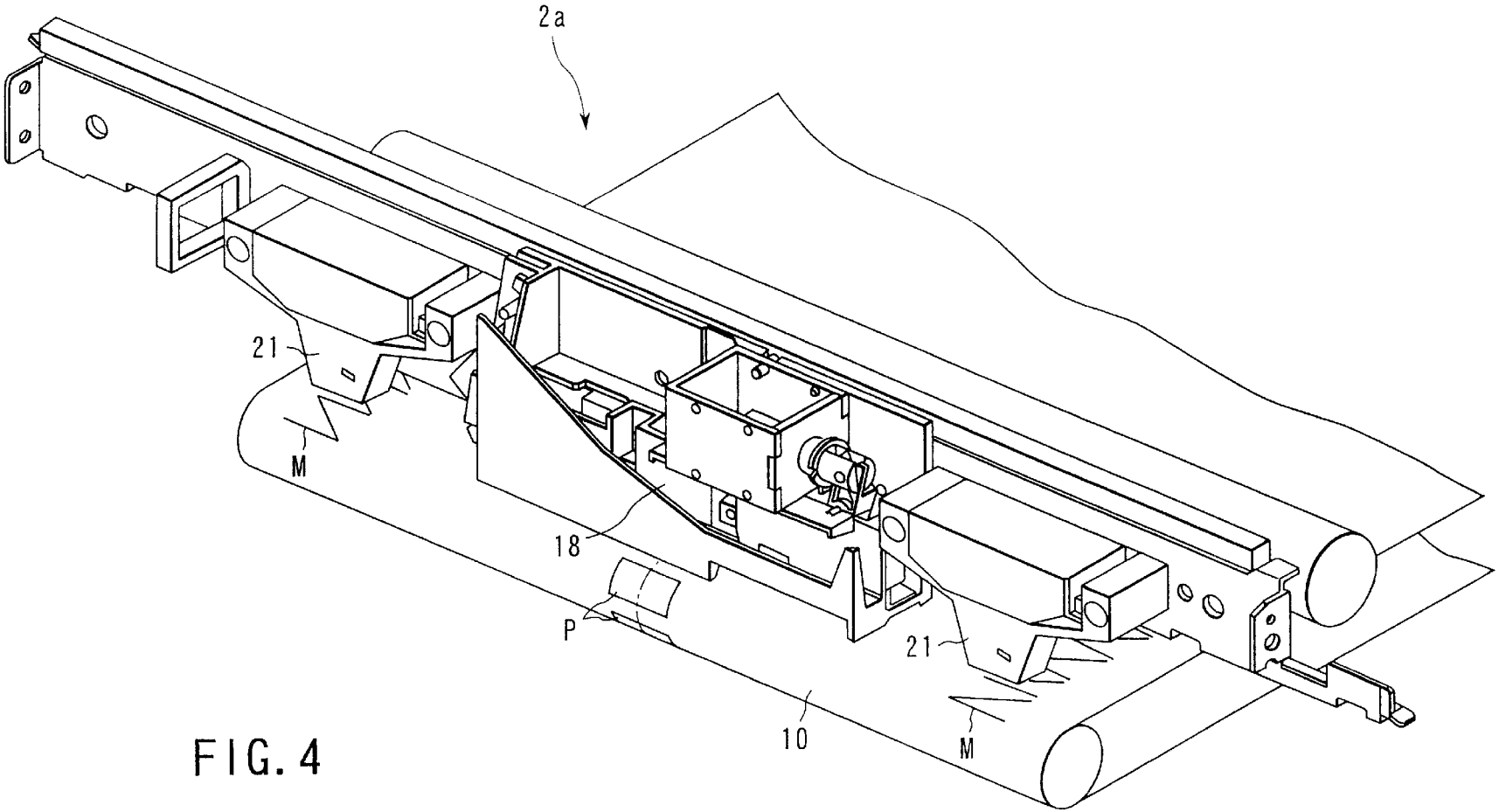
FIG. 4 is a schematic view showing a mechanism for correcting relative positional deviations of images formed by individual image forming sections of the image forming apparatus shown in FIG. 1.

FIG. 4 is a schematic view to be used to explain a mechanism for correcting relative positional deviations of images actually formed by the individual image forming sections 11 (Y, M, C, and B) of the color photocopying apparatus 101 shown in FIG. 1. A description that will be given below includes a description regarding a sequence for optimizing the image density. The description is included for the reason that there occur many cases in which characteristics of toner change according to the temperature variation and the aged deterioration, thereby causing the change in the image density, that is, the amount of toner adhering to the photosensitive-unit drums and the sheet material O.

First of all, a description will be given of the correction of the positional deviation of images.

Registration sensors 21 are provided in positions along the surface of the sheet material transfer belt 10; specifically, they are provided in predetermined positions on the downstream side spaced apart from the positions where the individual image forming sections 11 (Y, M, C, and B) and the sheet material transfer belt 10 oppose each other in the direction in which an arbitrary point on the sheet material transfer belt 10 moves. The registration sensors 21 are provided to individually detect that registration marks M have passed through. The registration marks M are provided for obtaining positional deviations of individual toner images in the direction perpendicular to the direction in which an arbitrary point on the sheet material transfer belt moves. The registration sensors 21 are provided at two portions spaced apart at a predetermined distance in the width direction of the sheet material transfer belt 10 (direction perpendicular to the direction in which the sheet materials O are transported).

The individual registration sensors 21 sequentially detect that a plurality of the registration marks M formed in the individual image forming sections 11 (Y, M, C, and B) has passed through their individual detection areas and output a plurality of mark detection signals. The mark detection signals are sequentially inputted to the time difference calculating circuit 119, and the time difference calculating circuit 119 uses the mark detection signals to calculate relative time differences among the individual mark detection signals, that is, the individual registration marks M. Therefore, the time difference calculating circuit 119 outputs time differences of the individual marks M.

Subsequently, a timing correction amount circuit 120 references a lookup table LUT1 and obtains correction amounts Z for correcting timing with which the individual image forming sections 11 (Y, M, C, and B) form images corresponding to the time differences obtained by the time difference calculating circuit 119.

Subsequently, with the obtained correction amounts Z, feedback is performed for the timing control section 113. This allows correction to be made for timing with which the individual image forming sections 11 (Y, M, C, and B) must form the images, that is, timing of image exposure with laser beams that correspond to the image forming signals and that are emitted from the exposing unit 4, thereby correcting levels of image-positional deviations. The operations for forming the registration marks M, calculating the time differences of the individual registration marks M, calculating the correction amounts Z, and correcting the exposure timing are repeated arbitrary times until the levels of image-positional deviations are corrected so as to be within an allowable level.

Hereinbelow, a description will be given of an image-density correcting sequence for optimizing the image density (output image density).

Toner density sensors 22 are provided to detect toner adhesion amounts as reflecting densities, that is, to detect amounts of toner adhered to the photosensitive-unit drums 12 and the sheet material transfer belt 10 at substantially the same phase as the registration sensors 21 for the direction in which the sheet materials O are transported and in substantially the center portion for the direction perpendicular to the direction in which the sheet materials O are transported in the vicinities of the registration sensors 21.

The sensor 22 sequentially detects that density-controlling density patches P of the individual colors, which have been formed at predetermined timing, have passed its detection area, and outputs a plurality of patch detection signals. The patch detection signals are sequentially inputted to a density determining circuit 149. The density determining circuit 149 outputs the individual patch detection signals, i.e., as density differences of the individual density patches P.

Subsequently, a density correction amount comparing circuit 150 references a lookup table LU2; and according to the densities obtained by the density determining circuit 149, it obtains correction amounts X for correcting densities of images formed by the individual image forming sections 11 (Y, M, C, and B).

Subsequently, with the correction amounts X, feedback is performed for the density determining circuit 149. According to the above, factors that determine image densities when the individual image forming sections 11 (Y, M, C, and B) form images are changed according to a predetermined routine, and new density patches P are thereby formed. The factors that determine the image densities include the amount of exposure light (laser-beam intensity), developing bias voltages according to the developing units 13, transcription voltages according to the transferring units 14, and amounts of charge from the charging units 17 to the photosensitive-unit drums 12. The operations for forming the density patches P, calculating densities of the individual patches P, calculating the correction amounts X, and correcting the exposure timing are repeated arbitrary times until image densities D are controlled so as to be in an allowable level.

Figure 5:
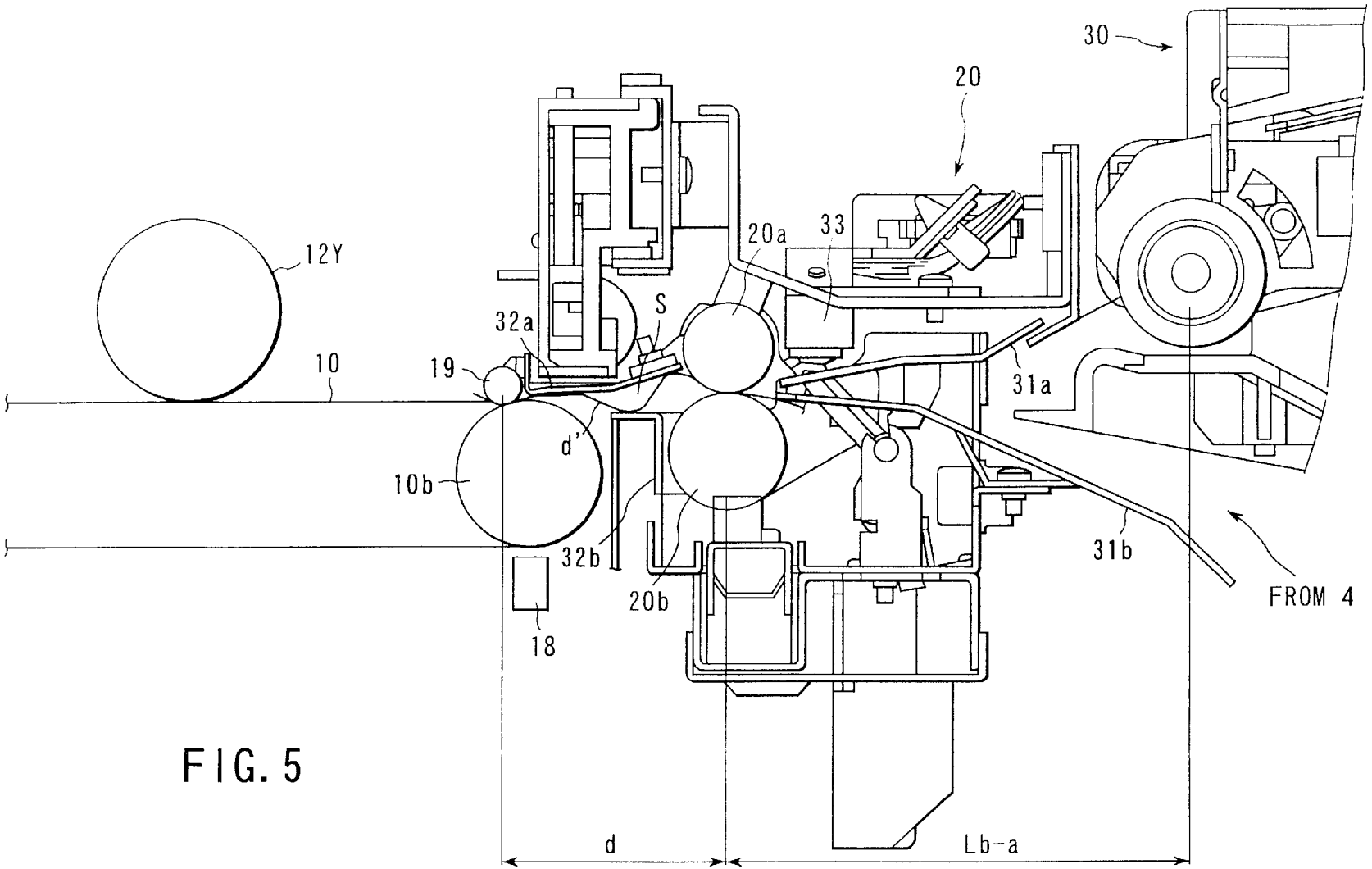
FIG. 5 is a schematic view showing the vicinity of an aligning section of the image forming apparatus shown in FIG. 1.

FIG. 5 is a schematic view showing the vicinity of the aligning section 20. As shown in FIG. 5, the bypass feeding section 30 is provided in the vicinity of the aligning rollers 20*a* and 20*b*; specifically, it is provided on the upstream side in the direction in which the sheet materials O are transported to the transferring unit 2*a*. The bypass feeding section 30 is capable of feeding the sheet materials O independently of the transcription-medium supplying section 4. A feed-in-side upper guide board 31*a* and a transportation-side lower guide board 31*b* are provided between the bypass feeding section 30 and the aligning rollers 20*a* and 20*b*. A feed-out-side upper guide board 32*a* and an ejecting-side lower guide board 32*b* are provided between the aligning rollers 20*a* and 20*b* and the sheet material transfer belt 10.

An OHP-sheet identifying sensor 33 (which will simply be referred to as an OHP identifying sensor, hereinafter) is provided in a predetermined position between the aligning rollers 20*a* and 20*b* and the feed-in-side upper guide board 31*a*. The OHP identifying sensor 33 identifies whether or not the sheet material O is a transparent OHP sheet for use with an overhead projector. When the sheet material O passing through the aligning section 20 is a nontransparent sheet paper, it outputs a predetermined signal. However, the sheet material O passing therethrough is a transparent OHP sheet, it does not issue the predetermined signal, but reports that an recording medium other than the sheet paper is passing through. The OHP identifying sensor 33 may use one of a reflecting-type optical sensor and a transparent-type optical sensor that are capable of identifying the sheet paper and the OHP sheet; however, the present invention uses the reflecting type to provide an adjusting function which will be described below in detail.

The OHP identifying sensor 33 identifies or detects a transportation speed Va at which the sheet materials O are transported toward the aligning rollers 20*a* and 20*b* in the aligning section 20. The registration sensors 21 described earlier identify or detect the transportation speed Vb for the sheet materials O in the transferring unit 2*a*.

Hereinbelow, referring to FIGS. 6 and 7, a description will be given of a color mode and a monochromatic mode.

Figure 6:
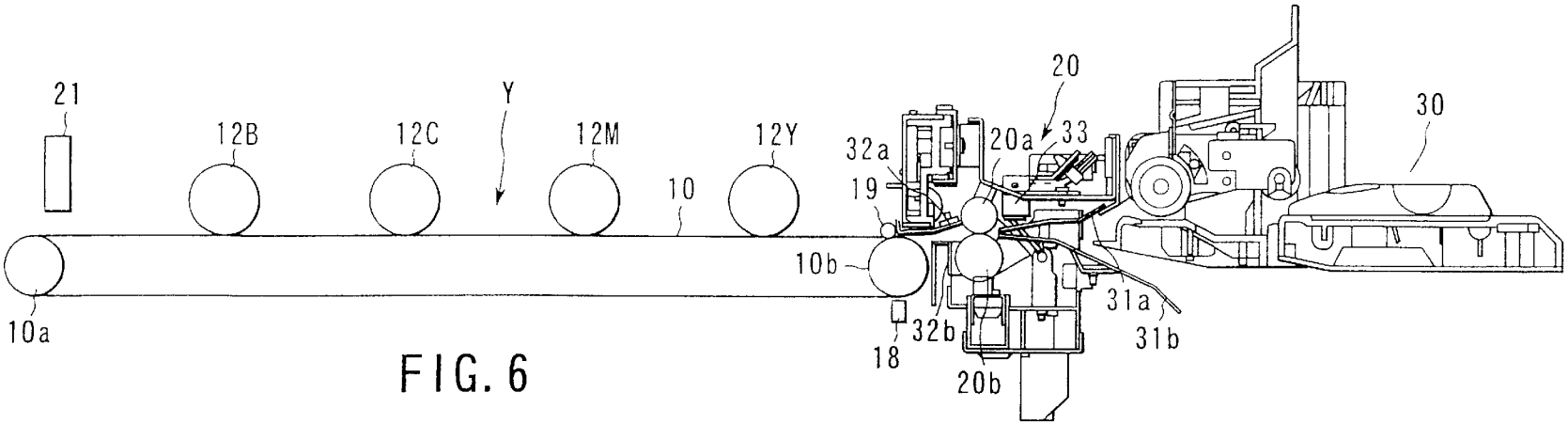
FIG. 6 is a schematic view showing a relation between an image forming unit and a sheet material transfer belt in a color mode.

As shown in FIG. 6, the color mode allows all the photosensitive-unit drums 12 (Y, M, C, and B) and the sheet material transfer belt 10 to be contacted.

Figure 7:
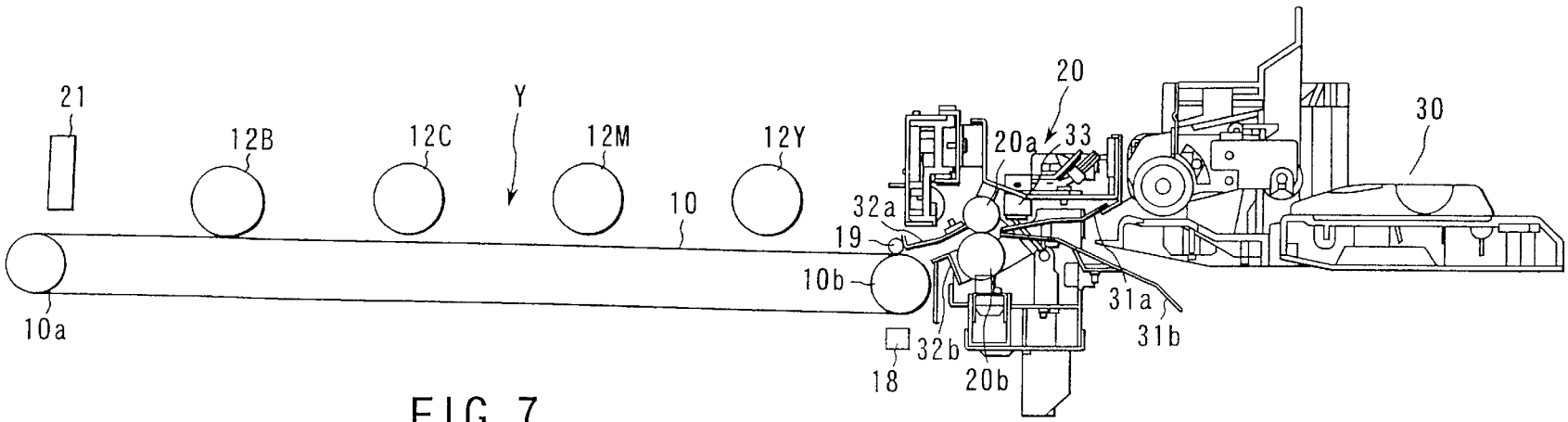
FIG. 7 is a schematic view showing a relation between an image forming unit and a sheet material transfer belt in a monochromatic mode.

However, as shown in FIG. 7, the transferring unit 2*a* is slanted with a rotationally contacting section where the black-handling photosensitive-unit drum 12 in the fourth image forming section 11B as a central point, and the photosensitive-unit drums 12 (Y, M, and C) are thereby relived from contact with the sheet material transfer belt 10 (the photosensitive-unit drums 12Y, 12M, and 12C are spaced apart from the sheet material transfer belt 10). This prevents the image forming sections 11 for unused colors and the corresponding photosensitive-unit drums 12 from being wore out and deteriorated. In this connection, as shown in FIG. 5, suppose a distance d between a point at which a peripheral point of each of the individual aligning rollers 20*a* and 20*b* is in contact with each other and the adsorption roller 19 is, for example, 46 mm. In this case, a total length d' of the sheet material O when it is deflected and deformed at maximum is 47.5 mm in consideration of a sheet material deflection space S, which represents a space surrounded by the feed-out-side upper guide board 32*a*, the ejecting-side lower guide board 32*b*, and the adsorption roller 19. A maximum length Lp of the sheet material O that can be used by the color photocopying apparatus 101 shown in FIG. 1 is, for example, the side of 17 inch of 11×17 (inches), which is about 432 mm. Therefore, with regard to the longitudinal direction of largest usable sheet material, a maximum sheet material-deflection allowable ratio αma, at which the sheet material O can deflect at maximum in the sheet material deflection space S, is defined as $$\alpha max=(d'-d)/Lp\approx 0.35(\%).$$

Accordingly, to adjust the sheet material transportation speed in the aligning section 20, deflections of the sheet materials O must be adjusted so as to be within the sheet material deflection space S.

Figure 9:
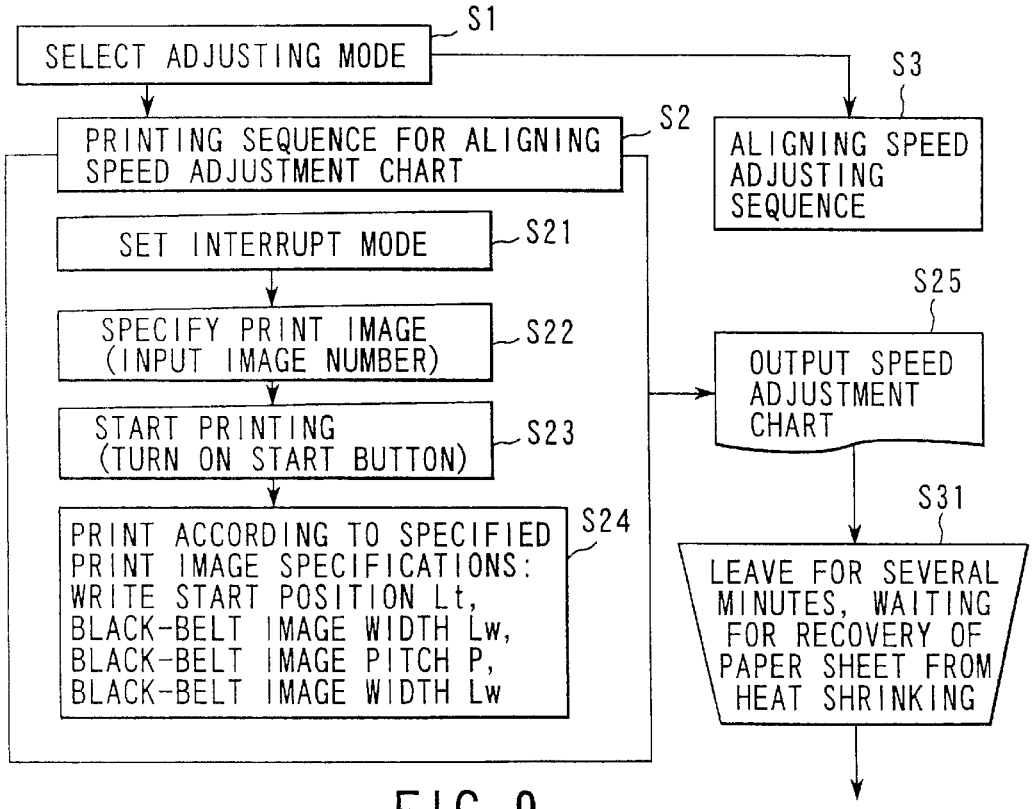
FIG. 9 is a flowchart to help explain a method of controlling the number of revolutions of the aligning motor.

Hereinbelow, according to actual adjusting operations, a description will be given of a method for controlling the number of revolutions of the aligning motor that drives the aligning rollers 20*a* and 20*b*. As shown in FIG. 9, first of all, an adjusting mode is selected (S1).

Subsequently, a print mode for a speed adjustment chart for the aligning section is selected in the adjusting mode (S2).

Figure 8:
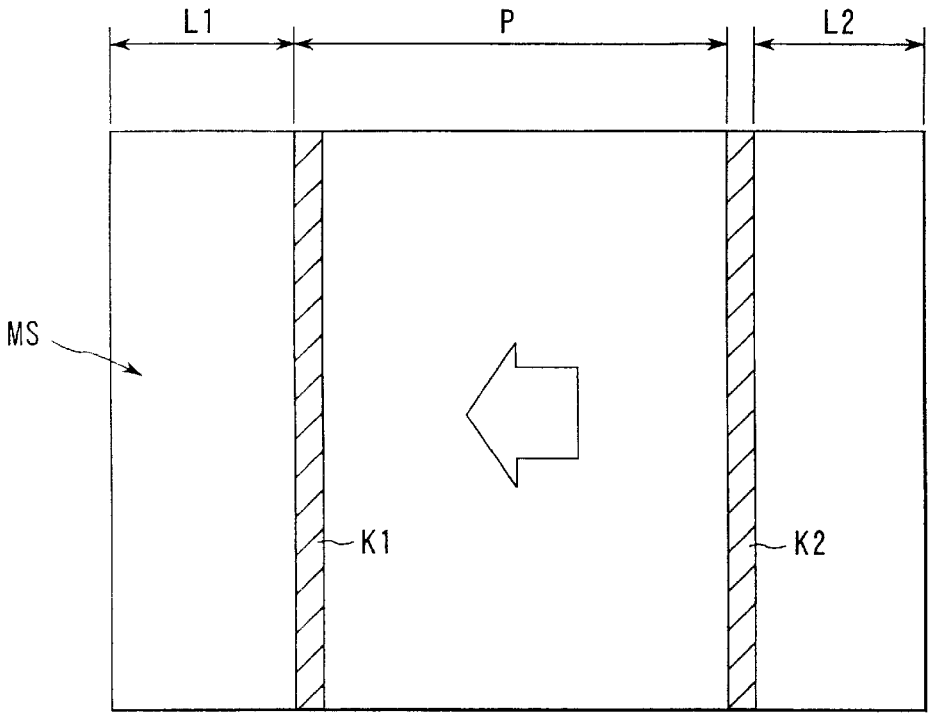
FIG. 8 is a schematic view showing a speed adjustment chart used for adjusting the transportation speed in the image forming apparatus shown in FIG. 1.

Subsequently, from the speed adjustment chart print mode, an interrupt mode is selected (S21). Then, from a menu in the interrupt mode, an image forming mode is set. The image forming mode is to output a speed adjustment chart MS on which adjustment images as shown in FIG. 8 are rendered, consisting of two black-belt images K1 and K2 (the left side is a transportation leading edge, and the left black belt is referred to as a first black-belt image K1; and the right side is a transportation tailing edge, and is referred to as a second black-belt image K2). Image data corresponding to the speed adjustment chart MS is partitioned according to image numbers and is prestored in a ROM 123. Therefore, in this particular case, only the image number is inputted using an input key 172 on a control panel 171 (S22).

Subsequently, when a start button (copy key) 173 on the control panel 171 is turned on, image forming for the chart MS is started (S23). Thereby, the chart MS on which the first black-belt image K1 having a write start position Lt and a width Lw and the second black-belt image K2 having a pitch P and the width Lw are formed (S24). Then, the toner images are fixed by the fixing unit 6 onto the sheet material O, and the fixed image is outputted (S25). The thickness Lw of each of the first and second black-belt images K1 and K2 is formed to have a thickness (width) of about 10 mm so as to be easily sensed by the OHP identifying sensor 33.

The speed adjustment chart MS on which the two black-belt images K1 and K2 are formed, formed in the described manner, is left for several minutes so as to be free of influence of heat shrinking (S31).

Hereinbelow, using the speed adjustment chart MS formed in step S21 to S25 described above, a description will be given of a transportation speed adjustment sequence for adjusting the transportation speed for the sheet materials O (S3). Subsequently, as shown in FIG. 8, an aligning speed adjustment mode is set. Various types of control in the speed adjustment mode are partitioned according to code numbers and prestored in the ROM 123. Therefore, in this particular case, only an image number is inputted using an input key on an operation panel (not shown) (S4).

In this case, in the transportation speed adjustment sequence, sheet materials having the size shorter than distances between the rotationally contacting section of the aligning rollers 20*a* and 20*b*, the sheet material transfer belt 10, and the photosensitive-unit drum 12B must be used to prevent the sheet material O either from being pulled by the black-handling photosensitive-unit drum 12B (the peripheral speed of the photosensitive-unit drum 12B is higher than the peripheral speeds of the aligning rollers 20*a* and 20*b*) or from being pushed out (the peripheral speeds of the aligning rollers 20*a* and 20*b* are higher than the peripheral speeds of the photosensitive-unit drum 12B).

With reference to FIG. 8, there occurs a case where a distance L1 from the transportation leading edge of the speed adjustment chart MS to the tailing edge of the first black-belt image K1, and a distance L2 from the tailing edge of the second black-belt image K2 to the tailing edge of the speed adjustment chart MS are varied because the speed adjustment chart MS either adheres to the sheet material transfer belt 10 or floats thereon.

To prevent output of erroneous measurement results produced by the OHP identifying sensor 33 because of the aforementioned variation in the distances, the peripheral speed of the outer periphery of a transporting roller 34 must be defined so that the speed adjustment chart MS becomes in a state of being pulled by the aligning rollers 20*a* and 20*b* and the transporting roller 34 provided in the bypass feeding section 30. For this reason, the distances L1 and L2 are individually set to be longer than the distance between the contact section of the aligning rollers 20*a* and 20*b* and the paper-transporting roller 34 (Lb-1, shown in FIG. 5).

The time difference in write timing for forming the individual black-belt images K1 and K2 corresponding to the pitch P between the first black-belt image K1 and the second black-belt image K2 is assumed to be "Tp".

Figure 10:
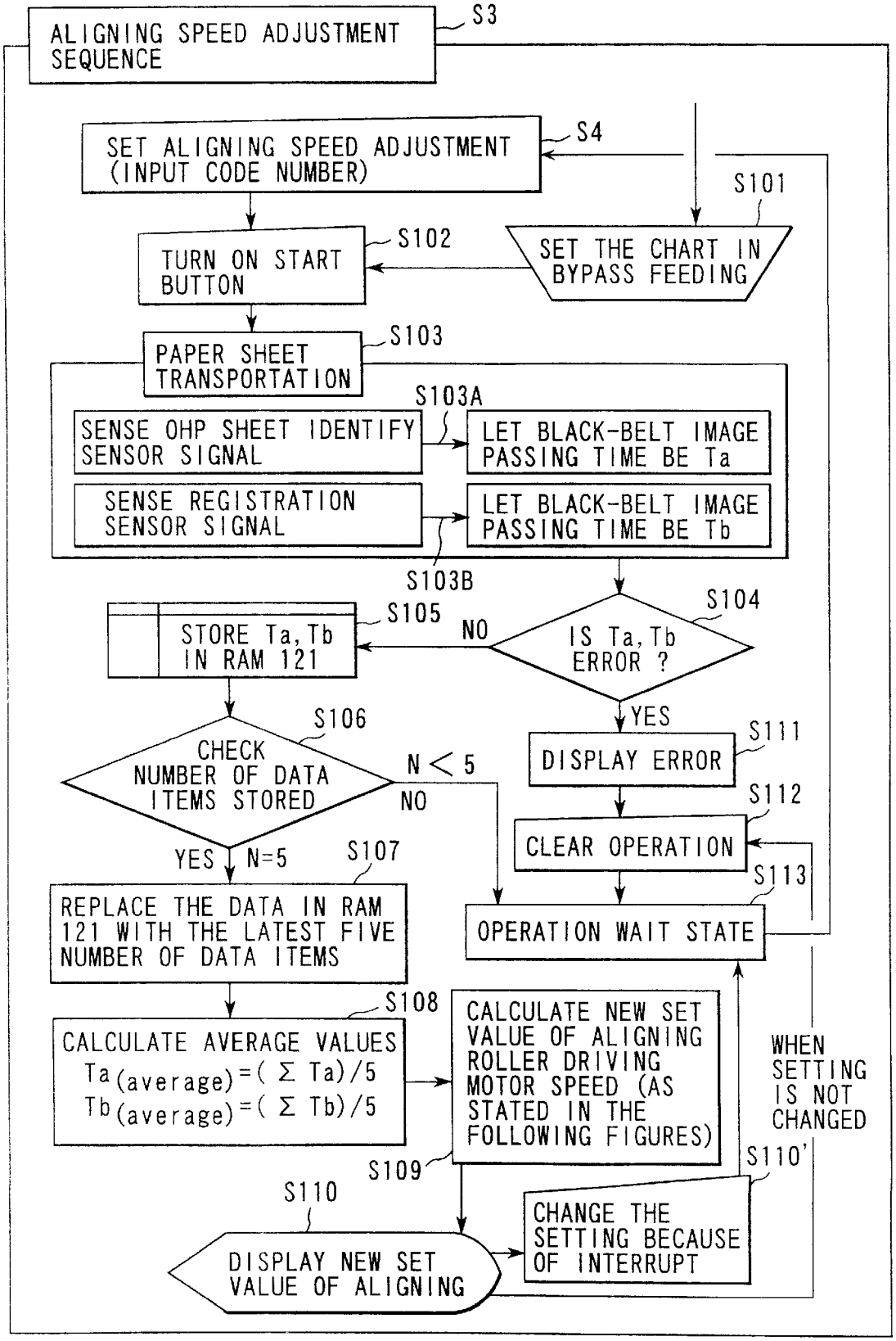
FIG. 10 is a flowchart to help explain a method of controlling the number of revolutions of the aligning motor.

Subsequently, as shown in FIG. 10, the speed adjustment chart MS, which was formed in steps S21 to S25 in FIG. 9 and has been left for several minutes, is set on the bypass feeding section 30 (S101), and the start button 172 on the control panel 171 is turned on (S102). The speed adjustment chart MS, that is, the black-belt images K1 and K2, need not be created, and a dedicated chart (not shown) on which two black-belt images preformed may instead be used. However, the arrangement allowing the color photocopying apparatus 101 to create the speed adjustment chart MS for its own use produces advantages. For example, it avoids necessity for consideration of influence of, for example, moisture adsorption, which causes deterioration in the accuracy of the speed adjustment chart MS. Other advantages are such that the speed adjustment chart MS need not be hand-carried for performing maintenance/inspection (may be overlooked to be hand carried); and even when the speed adjustment chart MS is damaged, it can be re-created and prepared any time when it is used.

When the start button 172 is turned on at step S102, the main control unit 111 performs control so as to transport the speed adjustment chart MS set in the bypass feeding section 30 from one end of the black-belt image K1 toward the transport path of the color copying machine 101 or toward the aligning section 20 (S103).

The main control unit 111 causes the OHP identifying sensor 33 and registration sensor 21 to sense the time from when the first black-belt image K1 on the speed adjustment chart MS transported at step S103 enters until the second black-belt image K2 enters (or from when the trailing edge of the first black-belt image K1 passes until the trailing edge of the second black-belt image passes), respectively (S103A, S103B).

Specifically, the main control unit 111 obtains the passing times Ta and Tb of the black-belt images on the basis of the outputs of the sensors 33 and 21. Let the value measured by the OHP identifying sensor 22 be Ta and the value measured by the registration sensor 21 be Tb.

The main control unit 111 judges whether or not each of the measured values Ta and Tb is an abnormal time (measurement error) (S104). When having judged that each of them is the proper value (NO at S104), the main control unit 111 records them as the similar values of the transportation speed Va at the aligning section 20 and the transportation speed Vb at the transfer belt 10 into the RAM 121 (S105).

Step S101 to step S105 are repeated more than once, for example, five times, taking into account the measurement errors and the deviation of the speed (or variations in the speed) at which the sheet material O passing through the aligning section 20 is transported (S106). The Ta and Tb repeatedly obtained are stored in the RAM 121 in such a manner that they are divided therein. The number of measured data items is equivalent to those obtained in five measurements at a maximum.

At step S106, after five Ta and five Tb have been obtained, an averaging sequence is started and the five data items are replaced with the latest five data items stored in the RAM 121 (S107), and the average value of each of Ta and Tb is determined using the following equations (S108):

$$Ta(average)=(\Sigma Ta)/5$$

$$Tb(average)=(\Sigma Tb)/5$$

On the other hand, the table of the count values corresponding to the aligning speeds has been stored in the ROM 123. Referring to the table stored in the ROM 123, the main control unit 111 sets the count value (set value) corresponding to the target aligning speed in the aligning motor speed control circuit 193, thereby controlling the aligning motor 20*m* that rotates the aligning rollers 20*a*, 20*b*.

Then, if the initial set value is Kd, the aligning speed ratio to the transfer belt is $\alpha$, the passing time of the black-belt image by the OHP identifying sensor 33 is Ta, and the passing time of the black-belt image by the registration sensor 21 is Tb, the main control unit 11 calculates a new set value (or an expected count set value) K1 of the aligning motor 20*m* using the following equation:

$$K1=f(Ta, Tb)=Kd/(-T/T+(2+\alpha))-1$$

The main control unit 111 sets the new count set value K1 calculated at step S109 in the aligning motor speed control circuit 193, thereby controlling the aligning motor 20*m* that rotates the aligning rollers 20*a*, 20*b*.

Using the above equation, the main control unit 111 can cause the relative difference between the sheet material transportation speed Va at the aligning section 20 and the sheet material transportation speed Vb on the transfer belt 10 to fall in the proper relative speed range in which the sheet material O can be transported within the range where the sheet material O can bend in the sheet material deflection space S, thereby preventing color shift from occurring particularly in the color mode.

At step S104, when the sheet material O jammed in the course of transportation prevents the OHP identifying sensor 33 and registration sensor 21 from outputting the passing times of the black-belt images K1 and K2, or when the outputs have been obtained from both of the sensors but they are obviously erroneous (YES at S104), the main control unit 111 displays the error on the liquid-crystal display section (not shown) of the control panel 171 (S111) and goes into the input wait state to accept the clear input (S112).

The input wait state to accept the clear input also serves to wait for input when the new count value calculated at each step of controlling the aligning motor 20*m* explained above is not used.

Hereinafter, in the input wait state (S112), when counting cannot be done up to "N=5" at step S106 because the aligning speed adjustment mode is interrupted or the sheet material O has got jammed (N at S106), or when the new count value obtained at each of the steps of controlling the aligning motor 20*m* explained above is changed again (S110'), the operation of accepting the input of the aligning speed adjustment mode is waited for (S113).

Next, a first embodiment of the present invention will be explained.

The result of experiments has shown that more than one adjustment is needed until the aligning speed has converged at a specific value, when the aligning speed has been adjusted. More than one adjustment becomes a problem in terms of manufacture. The following is an explanation of accurate automatic adjustment with a small number of processes using such an efficient algorithm as determines the proper target value automatically without fail through one measurement sequence.

Figure 11:
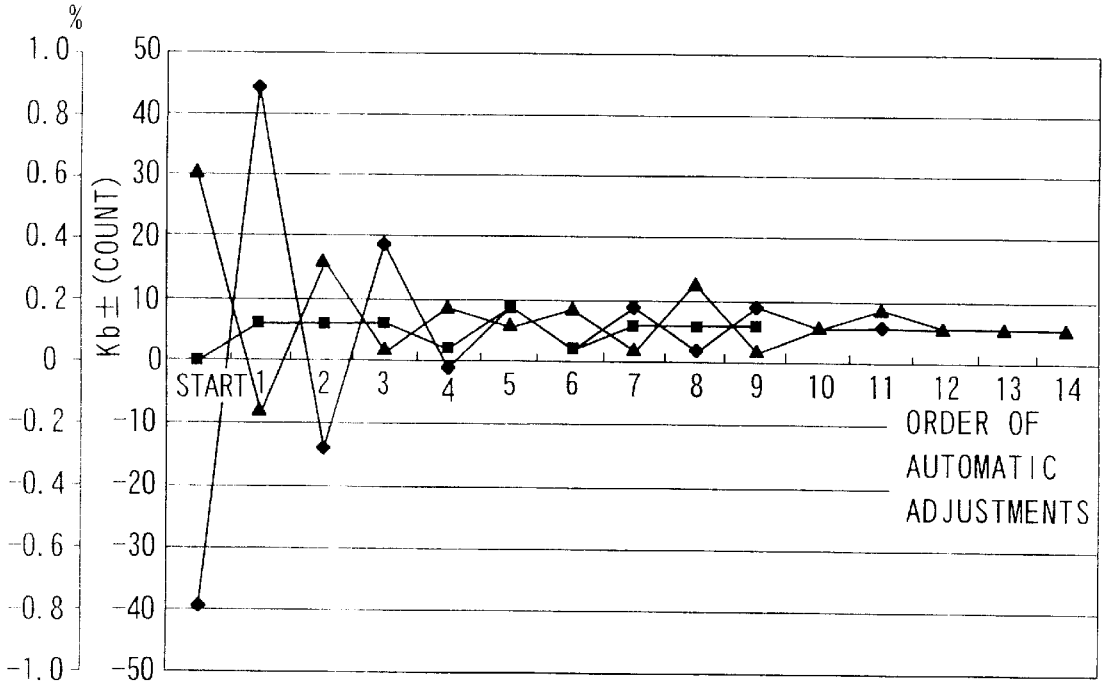
FIG. 11 is a diagram showing the way of converging gradually at the target value using an aligning speed adjustment equation.

The aligning speed adjustment equation requires the difference between the sheet material transportation speed at the aligning rollers and that on the transfer belt at the start of measurement to be 0% (default value). Generally, the target value has to be determined in one measurement. However, the default state is not necessarily at a sheet material transportation speed difference of 0% because of the difference between the aligning rollers. In that case, measurements are made under the conditions where the transportation speed difference of the sheet material O is at a value other than 0%. As shown in FIG. 11, in the experiments, the speed converged at the target value gradually.

Changing the count value set in the aligning motor speed control circuit 193 makes it possible to vary the aligning speed in proportion to the change. Namely, the aligning motor speed control circuit 193 controls the number of revolutions of the aligning motor 20*m* according to the set count value.

Therefore, in the first embodiment, the target value is determined using the present aligning speed adjustment equation making use of the gradual convergence. In the first embodiment, on the basis of the difference between the initial set value Kd and the expected count set value K1, the equation that calculates a new target value Ka is determined by three patterns explained below.

A first pattern is for a case where the absolute value of the value obtained by subtracting the count set value from the initial set value is equal to or smaller than 10 ($|Kd-K1| \leqq 10$).

At this time, although variations in the target value take place because of transportation errors in the aligning rollers 20*a*, 20*b* or the accuracy of the sensors 21, 33, the target value finally takes almost the central value.

Therefore, this gives:

$$Ka=(Kd+K1)/2 \quad \text{(equation 1)}$$

A second pattern is for a case where the absolute value of the value obtained by subtracting the count set value from the initial set value is equal to or smaller than 20 and larger than 10 ($20 \geqq |Kd-K1| > 10$).

At this time, the influence of the sheet material O being pulled or pressed by the transfer belt 10 or photosensitive drum 12 becomes greater than the transportation errors in the aligning rollers 20*a*, 20*b* or the accuracy of the sensors 21, 33 explained in the first pattern. To correct this, the following correction value is substituted into the equation:

1. When $Kd<K1$, $C=2$ is substituted as the correction constant into the equation below.

2. When $Kd>K1$, $C=-2$ is substituted as the correction constant into the equation below.

$$Ka=(Kd+K1)/2+C \quad \text{(equation 2)}$$

A third pattern is for a case where the absolute value of the value obtained by subtracting the count set value from the initial set value is larger than 20 ($|Kd-K1>20$).

At this time, the influence of the sheet material O being pulled or pressed by the transfer belt 10 or photosensitive drum 12 becomes greater as explained in the second pattern. The third pattern differs from the second pattern in that, when the sheet material O is pressed, the influence is a little because three is a space where the sheet material O bends, but when the sheet material is pulled, the strength at which the sheet material is pulled increases because the transportation speed difference becomes greater. Thus, the correction value is made as follows:

1. When $Kd<K1$, $C=4$ is substituted as the correction constant into equation 2.

2. When $Kd>K1$, $C=-8$ is substituted as the correction constant into equation 2.

Figure 12:
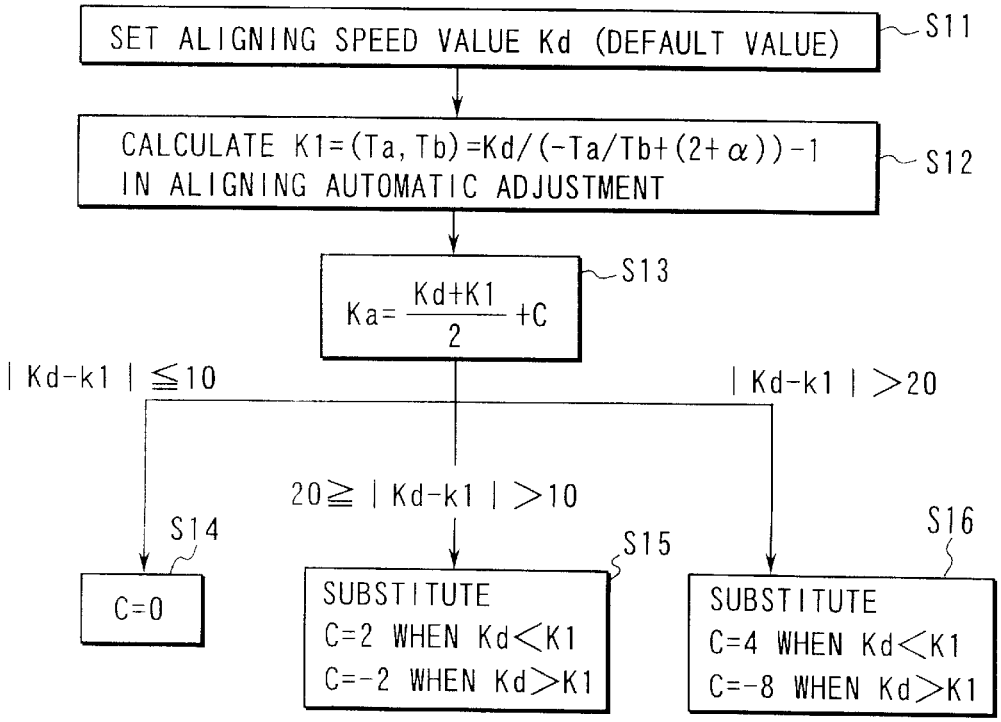
FIG. 12 is a flowchart to help explain the operation in aligning speed adjustment in the first embodiment.

Next, the operation in aligning speed adjustment of the first embodiment will be explained by reference to the flowchart of FIG. 12.

First, referring to the table of the count values corresponding to the aligning speeds stored in the ROM 123, the main control unit 111 sets an aligning speed value (Kd: default value) in the aligning motor speed control circuit 193 (S11).

Then, the main control unit 111 calculates the equation $K1=f(Ta, Tb)=Kd/(-Ta/Tb+(2+\alpha))-1$ measured by the above-described aligning speed adjustment sequence (S12), where f is a function.

Here, the main control unit 111 calculates the new target value $Ka=(Kd+K1)/2+C$ (S13). From the calculated K1, the main control unit 111 checks which one of $|Kd-K1| \leqq 10$, $20 \geqq |Kd-K1| > 10$, and $|Kd-K1|>20$ is satisfied and determines the value to be substituted.

If $|Kd-K1| \leqq 10$, the main control unit 111 substitutes $C=0$ (S14).

If $20 \geqq |Kd-K1| > 10$, the main control unit 111 substitutes $C=2$ when $Kd<K1$, and $C=-2$ when $Kd>K1$ (S15).

If $|Kd-K1|>20$, the main control unit 111 substitutes $C=4$ when $Kd<Kd1$, and $C=-8$ when $Kd>Kd1$ (S16).

The main control unit 111 can determine aligning speed adjustment in one measurement using the aligning speed adjustment equation determined in the above way.

As described above, with the first embodiment, the correct target value can be determined automatically without fail through one measurement sequence.

A supplementary explanation of the setting of the count value will be given.

In the embodiment, when the speed difference (between the initial set speed of the aligning rollers and the new set speed of the aligning rollers) is about 0.02% of the initial set speed, this is considered to be one count (see FIG. 11). Thus, when the difference in the count value is 10 or less, this means that the speed difference is 0 to 0.2% of the initial set speed. In this case, $C=0$ is substituted.

Similarly, when the difference in the count value is larger than 10 and equal to or less than 20, this means that the speed difference is larger than 0.2% and equal to or less than 0.4% of the initial set speed. In this case, if $Kd<K1$, the count value equivalent to 0.04% to 0.05% is substituted into C. In the example explained above, 0.04% has been employed and $C=2$ is used. On the other hand, when the difference in the count value is larger than 10 and equal to or smaller than 20, if $Kd>K1$, the value obtained by multiplying the count value equivalent to 0.04% to 0.5% by −1 is substituted into C. In the above example, $C=-2$ is substituted.

Furthermore, when the difference in the count value is larger than 20, this means that the speed difference is larger than 0.4% of the initial set speed. In that case, if $Kd<K1$, the count value equivalent to 0.08 to 0.1% is substituted. In the above example, $C=4$ is substituted as the count value equivalent to 0.08%. In addition, if $Kd<K1$, the value obtained by multiplying the count value equivalent to 0.16 to 0.2% by −1 is substituted into C. In the above example, $C=-8$ is substituted.

It goes without saying that what percentage of the initial set speed the speed difference occupies can be set arbitrarily as one count.

Figure 13:
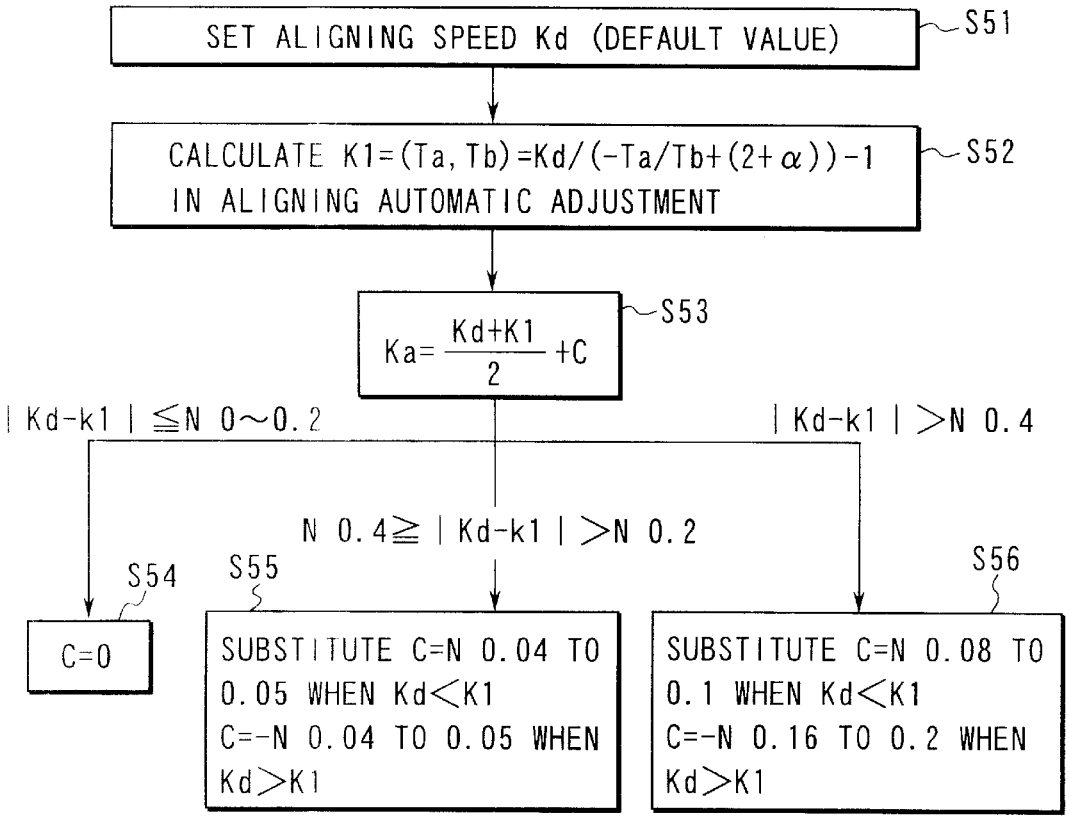
FIG. 13 is a flowchart to help explain the operation (counter value) in aligning speed adjustment in the first embodiment.

Referring to the flowchart of FIG. 13, a case where the counter value when the percentage of the speed difference with respect to the initial set speed is 0 to 0.2% is determined to be N0 to 0.2 will be explained.

First, referring to the table of the count values corresponding to the aligning speeds stored in the ROM 123, the main control unit 111 sets an aligning speed value (Kd: default value) in the aligning motor speed control circuit 193 (S51).

Then, the main control unit 111 calculates the equation $K1=f(Ta, Tb)=Kd/(-Ta/Tb+(2+\alpha))-1$ measured by the above-described aligning speed adjustment sequence (S52), where f is a function.

Here, the main control unit 111 calculates the new target value $Ka=(Kd+K1)/2+C$ (S53). From the calculated K1, the main control unit 111 checks which one of $|Kd-K1| \leqq N0$ to 0.2, $N0.4 \geqq |Kd-K1| > N0.2$, and $|Kd-K1| > N0.4$ is satisfied and determines the value to be substituted.

If $|Kd-K1| \leqq N0$ to 0.2, the main control unit 111 substitutes C=0 (S54).

If $N0.4 \geqq |Kd-K1| > N0.2$, the main control unit 111 substitutes C=N0.04 to 0.05 when Kd<K1, and C=−N0.04 to 0.05 when Kd>K1 (S55).

If $|Kd-K1| > N0.4$, the main control unit 111 substitutes C=N0.08 to 0.1 when Kd<K1, and C=−N0.16 to 0.2 when Kd>K1 (S56).

The main control unit 111 can determine aligning speed adjustment in one measurement using the aligning speed adjustment equation determined in the above way.

Next, a second embodiment of the present invention will be explained.

While in the first embodiment, automatic adjustment using the present aligning speed adjustment equation has been explained, the second embodiment provides much better aligning speed adjustment.

In the second embodiment, let the change rate of speed for one count in the counter value be $\tau$. Then, the expected count set value K1 is determined using the following equation:

$$K1=Kd+((Tb/Ta-1)\times 100-\alpha)/\tau$$

Figure 14:
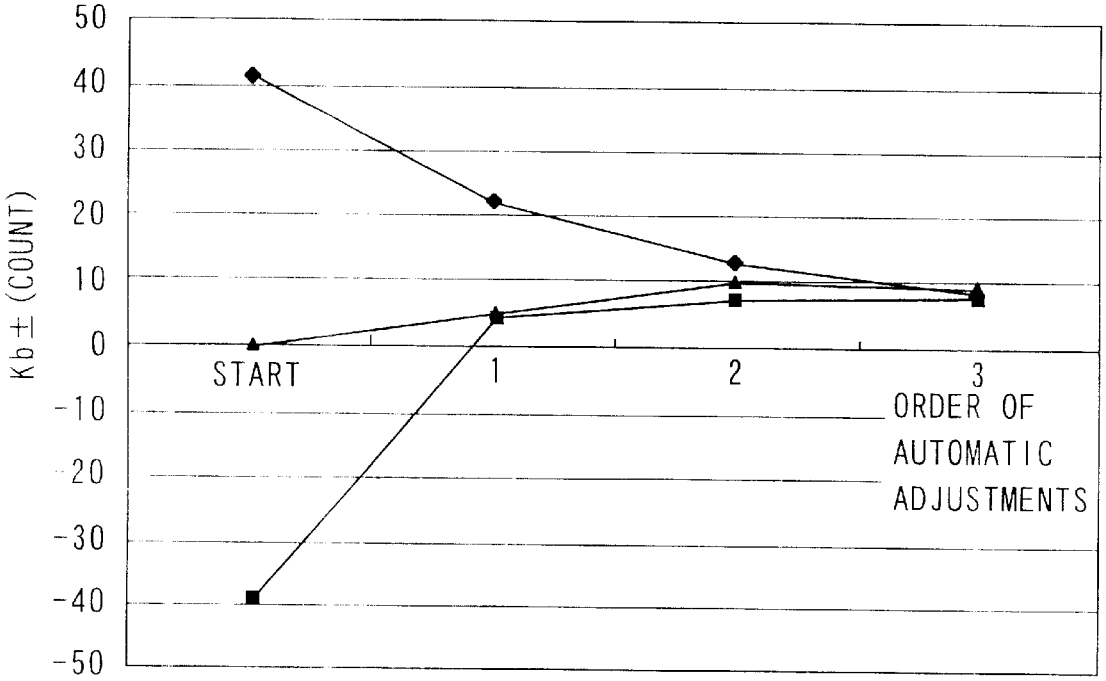
FIG. 14 is a diagram showing the way of converging at the target value using an aligning speed adjustment equation in the second embodiment.

As a result of conducting experiments using this equation, the speed converged from a constant direction gradually as shown in FIG. 14.

Figure 15:
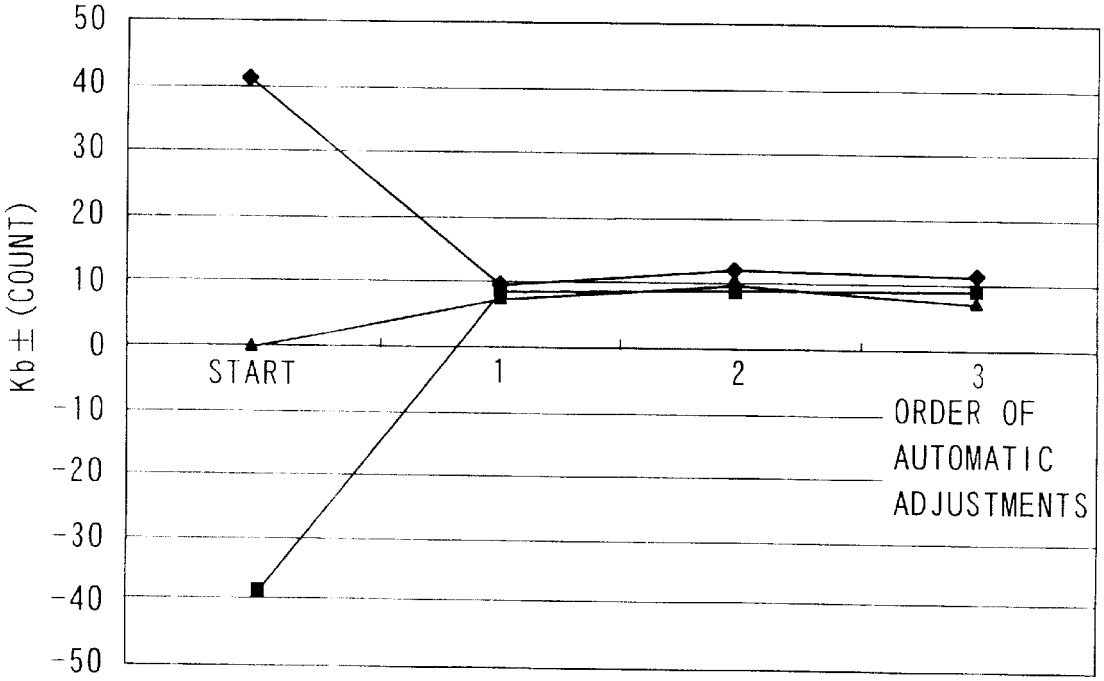
FIG. 15 is a diagram showing the way of converging at the target value as the result of carrying out experiments with the transfer belt removed.

Furthermore, as a result of making experiments without the transfer belt which can be considered to pull or press the sheet material O, the target value was reached in almost one experiment as shown in FIG. 15. Actually, however, measurements are very difficult without the transfer belt. Therefore, as shown in the first embodiment, it is necessary to make a correction to obtain the correct target value in one measurement.

In the second embodiment, on the basis of the difference between the initial set value Kd and the expected count set value K1, the equation that calculates a new target value Ka is determined by three patterns explained below.

A first pattern is for a case where the value obtained by subtracting the initial set value from the count set value is equal to or smaller than 0 ($K1-Kd \leqq 0$).

At this time, since the sheet material O is pulled, a measurement is made in a shorter time than the target time to be obtained, with the result that the measurement is taken faster than the originally expected target transportation speed.

Thus, from the above reason and the result of the experiment in FIG. 14, the following equation is given:

$$Ka = Kd - \sum_{n=0}^{m} (Kd - K1)/2^n \quad (\text{where } m > 0)$$

A second pattern is for a case where the value obtained by subtracting the initial set value from the count set value is equal to or smaller than 20 and larger than 0 ($20 \geqq K1-Kd > 0$).

At this time, since the bending of the sheet material O causes a pressing force, a measurement is made in a longer time than the target time to be obtained, with the result that the measurement is taken slower than the originally expected transportation speed.

Thus, from the above reason and the result of the experiment in FIG. 14, the following equation is given:

$$Ka=Kd+\beta(K1-Kd) \quad \beta=1.5 \text{ to } 2.5$$

A third pattern is for a case where the value obtained by subtracting the initial set value from the count set value is larger than 20 ($K1-Kd>20$).

At this time, although the sheet material O bends as described in the second pattern, the pressing force is much greater because the bending space is limited.

Thus, from the above reason and the result of the experiment in FIG. 14, the following equation is given:

$$Ka=Kd+\gamma(K1-Kd) \quad \gamma=1.0 \text{ to } 1.5$$

Figure 16:
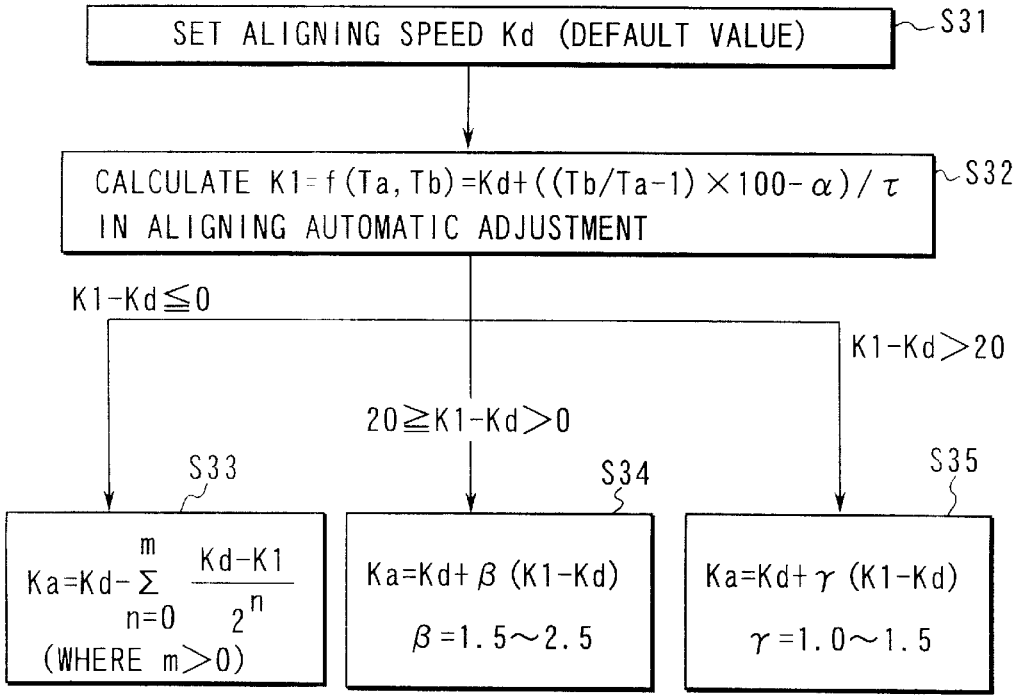
FIG. 16 is a flowchart to help explain the operation in aligning speed adjustment of the second embodiment.

Next, the operation in aligning speed adjustment of the second embodiment will be explained by reference to the flowchart of FIG. 16.

First, referring to the table of the count values corresponding to the aligning speeds stored in the ROM 123, the main control unit 111 sets an aligning speed value (Kd: default value) in the aligning motor speed control circuit 193 (S31).

Then, the main control unit 111 calculates the equation $K1=f(Ta, Tb)=Kd+((Tb/Ta-1)\times 100-\alpha)/\tau$ measured by the above-described aligning speed adjustment sequence (S32), where f is a function.

Here, the main control unit 111 calculates the new target value Ka.

If $K1-Kd \leqq 0$, the main control unit 111 does calculations using the following equation (S33):

$$Ka = Kd - \sum_{n=0}^{m} (Kd - K1)/2^n \quad (\text{where } m > 0)$$

If $20 \geqq K1-Kd > 0$, the main control unit 111 does calculations using the following equation (S34):

$$Ka=Kd+\beta(K1-Kd) \quad \beta=1.5 \text{ to } 2.5$$

If $Ka-Kd>20$, the main control unit 111 does calculations using the following equation (S35):

$$Ka=Kd+\gamma(K1+Kd) \quad \gamma=1.0 \text{ to } 1.5$$

The main control unit 111 can determine aligning speed adjustment in one measurement using the aligning speed adjustment equation determined in the above way.

As described above, with the second embodiment, the correct target value can be determined automatically without fail through one measurement sequence.

Although the count value can be set arbitrarily as explained in the first embodiment, the count value 20 in the second embodiment corresponds to 0.4% because, when the percentage of the speed difference with respect to the initial set speed is 0.02%, this is considered to be one count.

What is claimed is:

1. An image forming apparatus including image forming means for forming an image using developer, feeding means for feeding an image receiving medium toward the image forming means, transport means for transporting the fed image receiving medium, transfer means for transferring the developer image formed by said image forming means onto said image receiving medium, and fixing means for fixing the transferred developer image, said image forming apparatus characterized by comprising:

first control means for controlling the feeding speed at which said feeding means feeds the image receiving medium, on the basis of an initial set value previously set;

first sensing means for, when a specific medium is fed toward said image forming means from said feeding means whose feeding speed is controlled by the first control means, sensing the transportation speed of the specific medium;

second sensing means for sensing the transportation speed of said specific medium fed from said feeding means at which the specific medium is transported by said transport means;

first computing means for calculating a new set value of the feeding speed at said feeding means controlled by the first control means, from the transportation speed sensed by said first sensing means and the transportation speed sensed by said second sensing means;

second computing means for computing a target set value by making a correction according to the difference between the new set value calculated by the first computing means and said initial set value; and second control means for setting the target set value calculated by the second computing means in said first control means and then controlling the feeding speed of said feeding means.

2. The image forming apparatus according to claim 1, characterized in that said first control means, when a set value corresponding to said feeding speed is set, controls driving means that drives said feeding means on the basis of the set value just set.

3. The image forming apparatus according to claim 1, characterized in that said specific medium is an image receiving medium on which an image has been formed in a printing mode for a speed adjustment chart previously provided on the image forming apparatus.

4. The image forming apparatus according to claim 1, characterized in that said first sensing means is a reflecting optical sensor or transmitting optical sensor that discriminates between sheet paper and an OHP sheet.

5. The image forming apparatus according to claim 1, characterized in that said second sensing means is a registration sensor that senses a registration mark recorded on said transport means.

6. The image forming apparatus according to claim 1, characterized in that said first and second computing means and second control means constitute a main control unit that control the whole of the image forming apparatus.

7. An image forming apparatus including image forming means for forming an image using developer, feeding means for feeding an image receiving medium toward the image forming means, transport means for transporting the fed image receiving medium, transfer means for transferring the developer image formed by said image forming means onto said image receiving medium, and fixing means for fixing the transferred developer image, said image forming apparatus characterized by comprising:

first control means for controlling the feeding speed at which said feeding means feeds a specific medium, on the basis of an initial set value Kd previously set;

first sensing means for sensing the passing time Ta of said specific medium fed toward said image forming means from said feeding means whose feeding speed is controlled by the first control means;

second sensing means for, when said specific medium fed from said feeding means is transported by said transport means, sensing the passing time Tb of said specific medium transported over the transport means;

first computing means for calculating an expected set value K1 using the equation $K1=Kd/(-Ta/Tb+(2+\alpha))-1$, from the passing time Ta sensed by said first sensing means, the passing time Tb sensed by said second sensing means, a specific allowance ratio $\alpha$ of said feeding speed to the transportation speed of said transport means, and said initial set value Kd;

second computing means for determining a correction constant C according to the difference Kd−K1 between said initial set value Kd and the expected set value K1 and calculating a target set value Ka using the equation $Ka=(Kd+K1)/2+C$; and second control means for setting the target set value Ka calculated at the second computing means in said first control means and controlling the feeding speed of said feeding means.

8. The image forming apparatus according to claim 7, characterized in that the passing times Ta and Tb sensed by said first and second sensing means are the respective averages of the values sensed a plurality of times.

9. The image forming apparatus according to claim 7, characterized in that the correction constant C determined by said second computing means is such that, if $|Kd-K1|\leqq 10$, C=0 is substituted, if $20\geqq|Kd-K1|>10$, C=2 is substituted when Kd<K1 and C=−2 is substituted when Kd>K1, and if $|Kd-K1|>20$, C=4 is substituted when Kd<K1 and C=−8 is substituted when Kd>K1.

10. An image forming apparatus including image forming means for forming an image using developer, feeding means for feeding an image receiving medium toward the image forming means, transport means for transporting the fed image receiving medium, transfer means for transferring the developer image formed by said image forming means onto said image receiving medium, and fixing means for fixing the transferred developer image, said image forming apparatus characterized by comprising:

first control means for controlling the feeding speed at which said feeding means feeds a specific medium, on the basis of an initial count value Kd previously set;

first sensing means for sensing the passing time Ta of said specific medium fed toward said image forming means from said feeding means whose feeding speed is controlled by the first control means;

second sensing means for, when said specific medium fed from said feeding means is transported by said transport means, sensing the passing time Tb of said specific medium transported over the transport means;

first computing means for calculating an expected count value K1 using the equation $K1=Kd+((Tb/Ta-1)\times 100-\alpha)/\tau$, from the passing time Ta sensed by said first sensing means, the passing time Tb sensed by said second sensing means, a specific allowance ratio $\alpha$ of said feeding speed to the transportation speed of said transport means, the change rate $\tau$ of speed for one count in said count value, and said initial count value Kd;

second computing means for selecting the equation corresponding to the difference Kd−K1 between said expected count value K1 and initial count value Kd and calculating a target set value Ka; and second control means for setting the target count value Ka calculated at the second computing means in said first control means and controlling the feeding speed of said feeding means.

11. The image forming apparatus according to claim 10, characterized in that said second computing means selects an equation in such a manner that if K1−Kd≦0, it selects the following equation $$Ka = Kd - \sum_{n=0}^{m} (Kd - K1)/2^n \quad (\text{where } m > 0)$$

if 20≧K1−Kd>0, it selects the equation Ka=Kd+β(K1−Kd) where β=1.5 to 2.5, and if K1−Kd>20, it selects the equation Ka=Kd+γ(K1−Kd) where γ=1.0 to 1.5.

* * * * *